US008186318B2

(12) United States Patent
Sunada et al.

(10) Patent No.: US 8,186,318 B2
(45) Date of Patent: May 29, 2012

(54) VARIABLE VALVE OPERATING APPARATUS FOR INTERNAL COMBUSTION ENGINE

(75) Inventors: Hirotaka Sunada, Nishikamo-gun (JP); Kiyoharu Nakamura, Seto (JP); Shinobu Shimasaki, Toyota (JP); Motohiro Tsuzuki, Toyota (JP); Yusuke Kato, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 325 days.

(21) Appl. No.: 12/677,447

(22) PCT Filed: Mar. 12, 2009

(86) PCT No.: PCT/JP2009/054723

§ 371 (c)(1),
(2), (4) Date: Mar. 10, 2010

(87) PCT Pub. No.: WO2010/103637

PCT Pub. Date: Sep. 16, 2010

(65) Prior Publication Data

US 2011/0214636 A1 Sep. 8, 2011

(51) Int. Cl.
*F01L 1/34* (2006.01)

(52) U.S. Cl. ..... 123/90.16; 123/90.21; 123/90.15

(58) Field of Classification Search ..... 123/90.21, 123/90.24, 90.16, 90.44, 90.15
See application file for complete search history.

(56) References Cited

U.S. PATENT DOCUMENTS 5,809,953 A * 9/1998 Saito et al. ..... 123/90.16

FOREIGN PATENT DOCUMENTS

| | | | |
|---|---|---|---|
| JP | 62-184118 | | 11/1987 |
| JP | 10-008928 | A | 1/1998 |
| JP | 2000-008819 | A | 1/2000 |
| JP | 2008-267328 | A | 11/2008 |

* cited by examiner

*Primary Examiner* — Zelalem Eshete
(74) *Attorney, Agent, or Firm* — Kenyon & Kenyon LLP

(57) ABSTRACT

To provide a variable valve operating apparatus for an internal combustion engine which can reduce a range where heat treatment is required, thereby favorably suppressing distortion which occurs in a camshaft during heat treatment, to a low level. A changeover mechanism is provided which includes a slide pin which is adapted to move within a predetermined reciprocating range thereby switching between operational states of a variable mechanism, and a guide rail provided in an outer peripheral surface of the camshaft and guides the movement of the slide pin from one end to a remaining end of the reciprocating range. A projection part which is engageable with the guide rail is provided in the slide pin. Restriction means which performs at least one of a restriction of contact between a top surface of the projection part and a bottom surface of the guide rail opposing the projection part, and a restriction of movement of the slide pin beyond a distance from the above-described one end to the above-described remaining end.

6 Claims, 13 Drawing Sheets

(A)

Configuration of first embodiment (B)

Configuration of second embodiment

VARIABLE VALVE OPERATING APPARATUS FOR INTERNAL COMBUSTION ENGINE

This is a 371 national phase application of PCT/JP2009/054723 filed 12 Mar. 2009, the contents of which are incorporated herein by reference.

TECHNICAL FIELD

The present invention relates to a variable valve operating apparatus for an internal combustion engine.

BACKGROUND ART

So far, for example, Patent Document 1 discloses a variable valve operating apparatus for an internal combustion engine, which makes mechanically variable valve-opening characteristics of a valve. This conventional variable valve operating apparatus includes, between a cam and the valve, a rocker arm, which is supported by a rocker arm shaft so as to be rockable and movable in the axial direction of the shaft. Moreover, the above-described variable valve operating apparatus is provided with a helical guide groove in the outer peripheral surface of a camshaft, as well as a gondola including a projection part which is engageable with the guide groove. This gondola is supported by the camshaft so as to be movable in the axial direction and is connected with the rocker arm via a rod.

In the above-described conventional variable valve operating apparatus, an arrangement is made such that with the gondola being moved by a hydraulic actuator, the projection part and the guide groove become engaged with each other, and with the camshaft being rotated under this engagement state, the rocker arm moves in the axial direction of the rocker arm shaft via the gondola. Moreover, it is arranged such that with the rocker arm being moved, cams for pressing the valve are switched.

[Patent Document 1] Japanese Laid-open Utility Model Application Publication No. Sho 62-184118

DISCLOSURE OF THE INVENTION

Problem to be Solved by the Invention

In the above-described conventional variable valve operating apparatus, in a state in which the above-described projection part and the above-described guide groove are engaged with each other, the two slides with each other as the camshaft rotates. Because of this, it is necessary to subject the guide groove to a surface treatment in order to sufficiently ensure a hardness of the sliding portion. As the surface treatment, it is effective to perform a heat treatment such as a laser quenching in the aspect of the cost and the ease of production.

Basically, a range where hardening by heat treatment is required broadens as the sliding range between members broadens. When the range where hardening is required broadens, it becomes necessary to broaden a range where heat is input during heat treatment, thereby increasing the heat input. However, if the heat input range broadens or the heat input amount during heat treatment increases, a distortion which occurs in the camshaft becomes increased. As a result of that, friction loss of the internal combustion engine increases due to deformation of the camshaft such as a bending, thereby degrading fuel economy.

The present invention has been made to solve the above-described problem, and has its object to provide a variable valve operating apparatus for an internal combustion engine, which can reduce the range where heat treatment is required, thereby favorably suppressing the distortion which occurs in the camshaft during heat treatment to a low level.

Means for Solving the Problem

A first aspect of the present invention is a variable valve operating apparatus for an internal combustion engine, the apparatus comprising:

a variable mechanism disposed between a cam and a valve, the variable mechanism being adapted to change valve-opening characteristics of the valve; and a changeover mechanism for switching between operational states of the variable mechanism, wherein the changeover mechanism includes:

a displacement member adapted to move within a predetermined reciprocating range thereby switching between the operational states of the variable mechanism;

a guide part provided in an outer peripheral surface of a camshaft to which the cam is fixed, the guide part being adapted to guide movement of the displacement member from one end to a remaining end of the reciprocating range;

a projection part provided in the displacement member, the projection part being engageable with the guide part;

engagement control means for switching between an engagement state and a non-engagement state of the projection part and the guide part; and restriction means for performing at least one of a restriction of contact between a top surface of the projection part and a surface of the guide part opposing the projection part, and a restriction of movement of the displacement member beyond a distance from the one end to the remaining end.

A second aspect of the present invention is the variable valve operating apparatus for the internal combustion engine according to the first aspect of the present invention, wherein the displacement member includes a main shaft part which is in contact with the variable mechanism, wherein the changeover mechanism includes a support member which supports the main shaft part being axially movable and rotatable, wherein the displacement member includes an arm part fixed to the main shaft part to be rotatable about an axial center of the main shaft part;

wherein the projection part is fixed to the arm part, and wherein the restriction means is means for performing the restriction of the contact between the top surface of the projection part and the surface of the guide part opposing the projection part through a restriction of a rotational amount of the arm part with respect to the support part.

A third aspect of the present invention is the variable valve operating apparatus for the internal combustion engine according to the first or second aspect of the present invention, wherein the displacement member includes a main shaft part which is in contact with the variable mechanism, wherein the changeover mechanism includes a support member which supports the main shaft part being axially movable and rotatable, wherein the displacement member includes an arm part fixed to the main shaft part so as to be rotatable about an axial center of the main shaft part, wherein the projection part is fixed to the arm part, and wherein when the displacement member is located in the remaining end of the reciprocating range, the restriction, by the restriction means, of the movement of the displacement member beyond the distance from the one end to the remaining end is realized by the arm part coming into abutment with the support part.

A fourth aspect of the present invention is the variable valve operating apparatus for the internal combustion engine according to any one of the first to third aspects of the present invention, wherein the restriction means is means which performs at least the restriction of the movement of the displacement member beyond the distance from the one end to the remaining end, and wherein the camshaft includes a guide wall of a stepped shape in the outer peripheral surface as the guide part, and does not include a wall part at a portion opposing the guide wall with the projection part interposed therebetween.

A fifth aspect of the present invention is the variable valve operating apparatus for the internal combustion engine according to any one of the first to fourth aspects of the present invention, wherein the variable mechanism includes a first rocker arm which oscillates in synchronicity with the cam and a second rocker arm which can press the exhaust valve, and wherein the changeover mechanism is a mechanism which includes a changeover pin disposed to be insertable to a pin hole formed in the first rocker arm and the second rocker arm respectively, and which switches between a connection state in which the first rocker arm and the second rocker arm are in connection with each other via the changeover pin and a disconnection state in which the connection is released in response to the movement of the displacement member which is in contact with the changeover pin.

ADVANTAGES OF THE INVENTION

According to the first aspect of the present invention, by the provision of the restriction means which performs at least one of the restriction of the contact between the top surface of the projection part and the surface of the camshaft opposing the projection part, and the restriction of the movement of the displacement member beyond the distance from one end to remaining end of the predetermined reciprocating range, it is made possible to effectively reduce the sliding portion between the projection part and the guide rail when the displacement member moves guided by a guide part. Since, as a result of this, the heat input range and the heat input amount during heat treatment can be effectively reduced, it becomes possible to favorably suppress the distortion which occurs in the camshaft, to a low level. As a result, since the deformation of the camshaft such as a bending can be suppressed, it is possible to prevent an increase in the friction loss of the internal combustion engine.

According to the second aspect of the present invention, it is possible to restrict the rotation of the displacement member at a portion where there is no need of relying on the abutment with the camshaft which is a rotational body. That is, it is possible to achieve a configuration which can avoid the contact between the top surface of the projection part and the surface of the guide part opposing the top surface without being attended with sliding between the displacement member and the camshaft.

According to the third aspect of the present invention, it is possible to implement the restriction of the movement of the displacement member beyond the distance from the above-described one end to the above-described remaining end without the need of the addition of new components.

According to the fourth aspect of the present invention, by the arrangement that the wall part is not provided at the portion opposing the guide wall via the projection part therebetween, it is made easy to perform heat treatment such as a laser quenching with only the guide wall which contacts with the projection part as the target.

According to the fifth aspect of the present invention, it is possible to achieve excellent advantages by the above-described first to fourth aspects of the present invention in the configuration including the changeover mechanism which switches between the connection and disconnection of two kinds of rocker arms by utilizing the changeover pin which operates in association with the displacement member.

DESCRIPTION OF SYMBOLS

Figure 1:
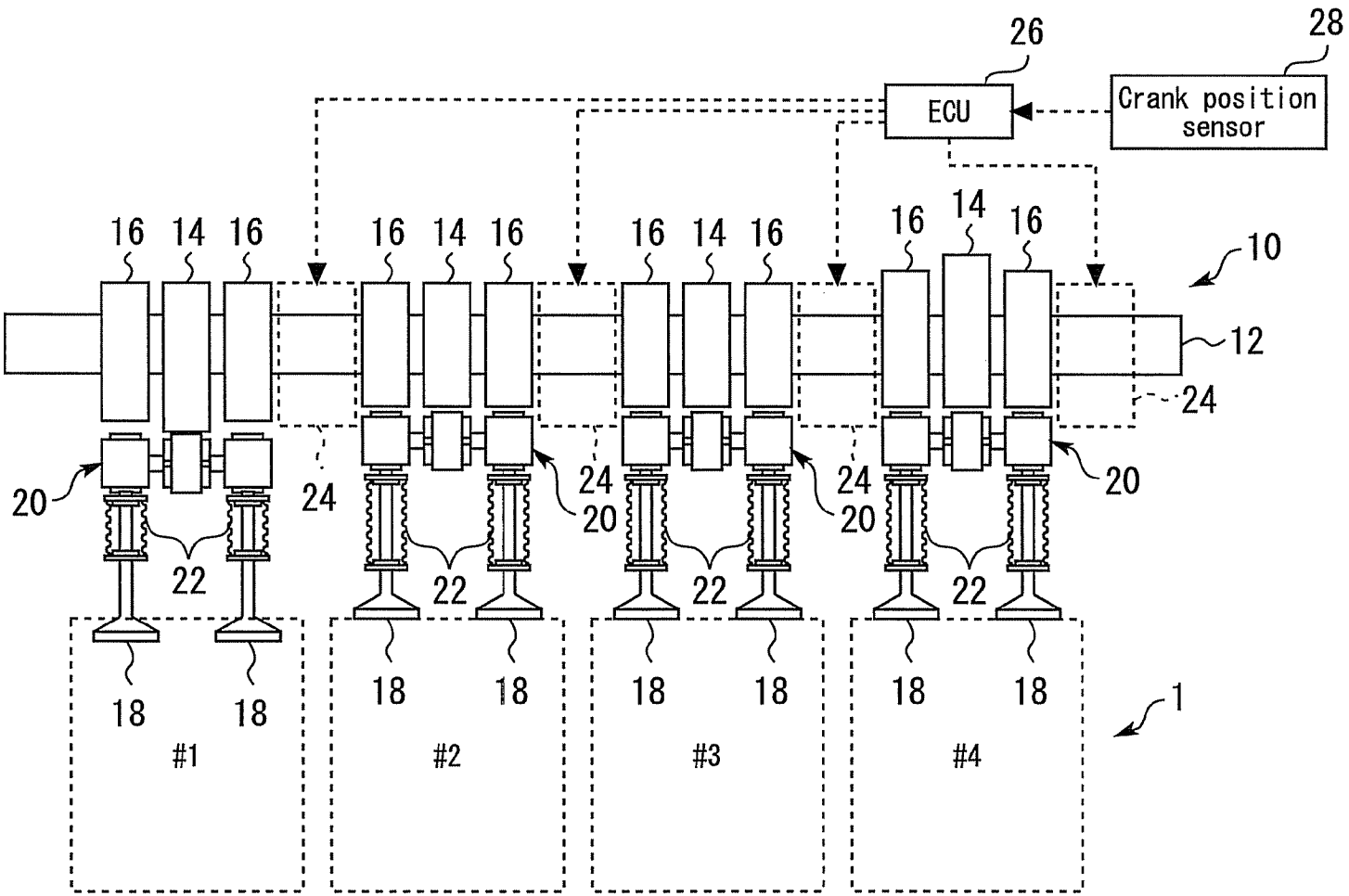
FIG. 1 is a schematic diagram showing the overall configuration for a variable valve operating apparatus for an internal combustion engine according to a first embodiment of the present invention.

1 internal combustion engine
10 variable valve operating apparatus
12 camshaft
14 main cam
14*a* base circle part
14*b* nose part
16 auxiliary cam
18 valve
20 variable mechanism
24 changeover mechanism
26 ECU (Electronic Control Unit)
32 first rocker arm
34L, 34R second rocker arm
46 first pin hole
48 first changeover pin
52L, 52R second pin hole
54L, 54R second changeover pin
56 return spring
58, 84 slide pin
58*a* circular column part
58*b* arm part
58*c*, 84*c* projection part
58*d* pressing surface
58*e* notch part
58*f* guide surface
58*g*, 60*a*, 60*b* stopper pin
58*h*, 84*h* top surface of projection part
60 support member
62, 82 large diameter part
64, 80 guide rail
64*a* proximal end
64*b* terminal end
64*c* shallow bottom part
64*d*, 80*d* bottom surface
64*e*, 80*e* load bearing surface
64*f* opposing surface
66 actuator
68 solenoid
68*a* drive axis
70 lock pin
Pmax1, Pmax2 displacement end

BEST MODE FOR CARRYING OUT THE INVENTION

First Embodiment

First, a first embodiment of the present invention will be described with reference to FIGS. 1 to 17.

[Overall Configuration of Variable Valve Operating Apparatus]

FIG. 1 is a schematic diagram showing the overall configuration of a variable valve operating apparatus 10 for an internal combustion engine 1 according to the first embodiment of the present invention.

Here, the internal combustion engine 1 is supposed to be a straight 4-cylinder engine having four cylinders (#1 to #4) in which the combustion stroke take places in the order from #1 to #3, to #4, and to #2. Moreover, suppose that two intake valves and two exhaust valves are provided in each cylinder of the internal combustion engine 1. Thus, it is supposed that the configuration shown in FIG. 1 functions as a mechanism to drive two intake valves or two exhaust valves disposed in each cylinder.

The variable valve operating apparatus 10 of the present embodiment includes a camshaft 12. The camshaft 12 is connected to a crankshaft, which is not shown, by means of a timing chain or a timing belt and is configured to rotate at a half speed of that of the crankshaft. The camshaft 12 is formed with a main cam 14 and two auxiliary cams 16 for one cylinder. The main cam 14 is disposed between two auxiliary cams 16.

The main cam 14 includes an arc-shaped base circle part 14*a* (see FIG. 3) concentric with the camshaft 12, and a nose part 14*b* (see FIG. 3) which is formed such that a part of the base circle expands outwardly in the radial direction. Moreover, in the present embodiment, the auxiliary cam 16 is configured to be a cam which includes only a base circle part (a zero lift cam) (see FIG. 4).

A variable mechanism 20 is interposed between the cam 14, 16 and the valve 18 of each cylinder. That is, the acting forces of the cams 14 and 16 are arranged to be transferred to the two valves 18 via the variable mechanism 20. The valve 18 is adapted to be opened and closed by use of the acting force of the cams 14 and 16, and the biasing force of valve spring 22.

The variable mechanism 20 is a mechanism to change the valve-opening characteristics of the valve 18 by switching between the state in which the acting force of the main cam 14 is transferred to the valve 18 and the state in which the acting force of the auxiliary cam 16 is transferred to the valve 18. Note that, in the present embodiment, since the auxiliary cam 16 is a zero-lift cam, the state in which the acting force of the auxiliary cam 16 is transferred to the valve 18 refers to a state in which neither opening nor closing of the valve 18 take place (a valve halted state).

Moreover, the variable valve operating apparatus 10 of the present embodiment includes, for each cylinder, a changeover mechanism 24 for driving each variable mechanism 20 to switch between operational states of the valve 18. The changeover mechanism 24 is adapted to be driven according to a driving signal from an ECU (Electronic Control Unit) 26. The ECU 26, which is an electronic control unit for controlling the operating state of the internal combustion engine 1, controls the changeover mechanism 24 based on the output signal of a crank position sensor 28 and the like. The crank position sensor 28 is a sensor for detecting a rotational speed of the output shaft (crankshaft) of the internal combustion engine 1.

(Configuration of Variable Mechanism)

Next, a detailed configuration of the variable mechanism 20 will be described with reference to FIGS. 2 to 4.

Figure 2:
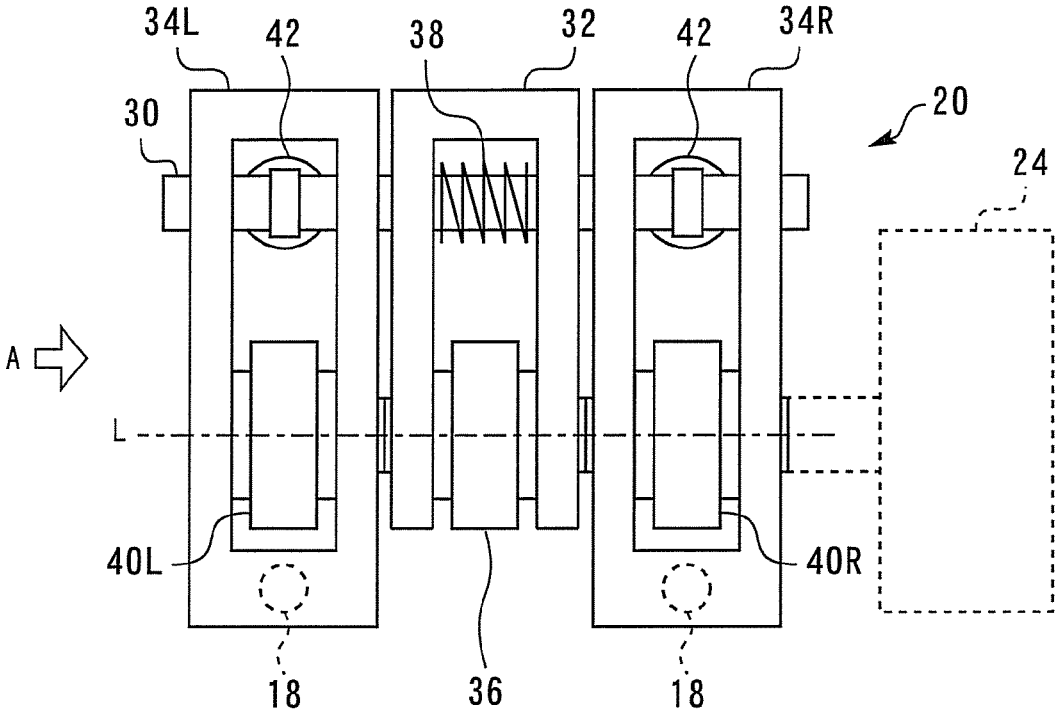
FIG. 2 is a look-down view of the variable mechanism shown in FIG. 1 seen from the proximal end part side of the valve.

FIG. 2 is a look-down view of the variable mechanism 20 shown in FIG. 1 seen from the proximal end part side of the valve 18.

The variable mechanism 20 includes a rocker shaft 30 which is disposed in parallel with the camshaft 12. As shown in FIG. 2, a first rocker arm 32 and a pair of second rocker arms 34R and 34L are rotatably attached to the rocker shaft 30. The first rocker arm 32 is disposed between the two second rocker arms 34R and 34L. Note that, in the present description, the right and left second rocker arms 34R and 34L may be referred to simply as a second rocker arm 34 when they are not particularly discriminated.

Figure 3:
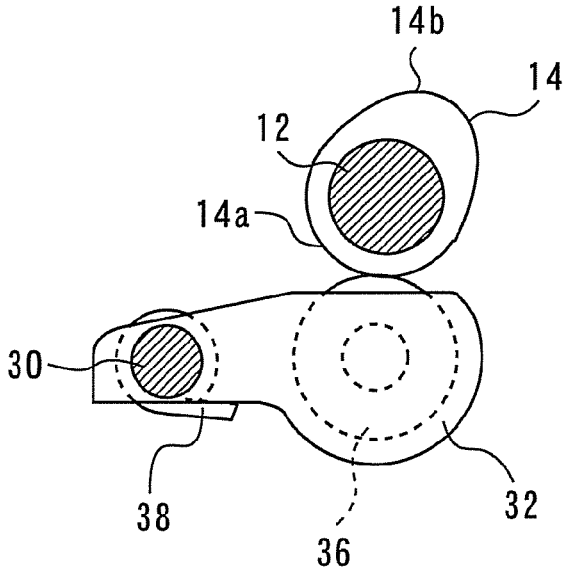
FIG. 3 is a view of a first rocker awl seen from the axial direction (the direction shown by an arrow A in FIG. 2) of a rocker shaft.
Figure 4:
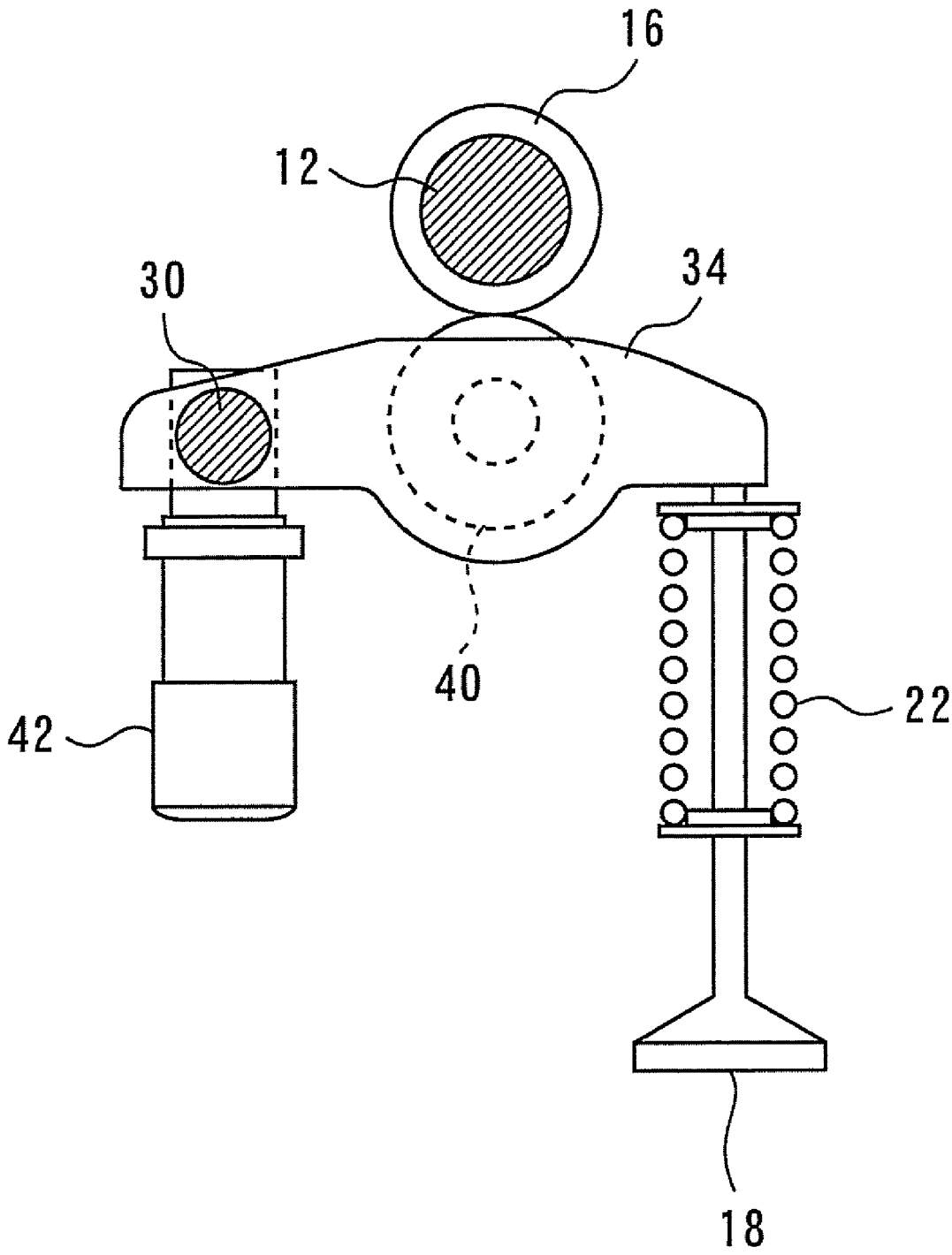
FIG. 4 is a view of a second rocker arm seen from the axial direction (the direction shown by the arrow A) of the rocker shaft in the same manner as in FIG. 3.

FIG. 3 is a view of the first rocker arm 32 seen from the axial direction (the direction shown by an arrow A in FIG. 2) of the rocker shaft 30, and FIG. 4 is a view of the second rocker arm 34 seen from the axial direction (the direction shown by the arrow A) of the rocker shaft 30 in the same manner as in FIG. 3.

As shown in FIG. 3, a first roller 36 is rotatably attached to the end part opposite to the rocker shaft 30 in the first rocker arm 32 at a position which allows a contact with the main cam 14. The first rocker arm 32 is biased by a coil spring 38 attached to the rocker shaft 30 such that the first roller 36 is constantly in abutment with the main cam 14. The first rocker arm 32 configured as described above oscillates with the rocker shaft 30 as a fulcrum through the cooperation between the acting force of the main cam 14 and the biasing force of the coil spring 38.

On the other hand, as shown in FIG. 4, the proximal end part of the valve 18 (specifically, the proximal end part of the valve stem) is in abutment with the end part opposite to the rocker shaft 30 in the second rocker arm 34. Moreover, a second roller 40 is rotatably attached to a central portion of the second rocker arm 34. Note that the outer diameter of the second roller 40 is equal to the outer diameter of the first roller 36.

Moreover, it is supposed that the rocker shaft 30 is supported by a cam carrier (or, for example, a cylinder head), which is a stationary member of the internal combustion engine 1, via a rush adjuster 42 at the other end of the second rocker arm 34. Therefore, the second rocker arm 34 is biased toward the auxiliary cam 16 by being subjected to an upward force from the rush adjuster 42. Note that when the auxiliary cam is a lift cam including a nose part unlike a zero lift cam of the present embodiment, the second rocker arm 34 is pressed against the auxiliary cam by the valve spring 22 while the auxiliary cam lifts up the valve 18.

Further, the position of the second roller 40 with respect to the first roller 36 is defined such that the axial center of the second roller 40 and the axial center of the first roller 36 are positioned on the same straight line L as shown in FIG. 2, when the first roller 36 is in abutment with the base circle part 14*a* of the main cam 14 (see FIG. 3) and the second roller 40 is in abutment with the base circle part of the auxiliary cam 16 (see FIG. 4).

(Configuration of Changeover Mechanism)

Next, a detailed configuration of the changeover mechanism 24 will be described with reference to FIGS. 5 and 6.

The changeover mechanism 24, which is a mechanism for switching the connection and disconnection concerning the first rocker arm 32 and the second rocker arm 34, makes it possible to switch the operational states of the valve 18 between a valve operable state and valve stop state by switching the state in which the acting force of the main cam 14 is transferred to the second rocker arm 34 and the state in which the forgoing acting force is not transferred to the second rocker arm 34.

Figure 5:
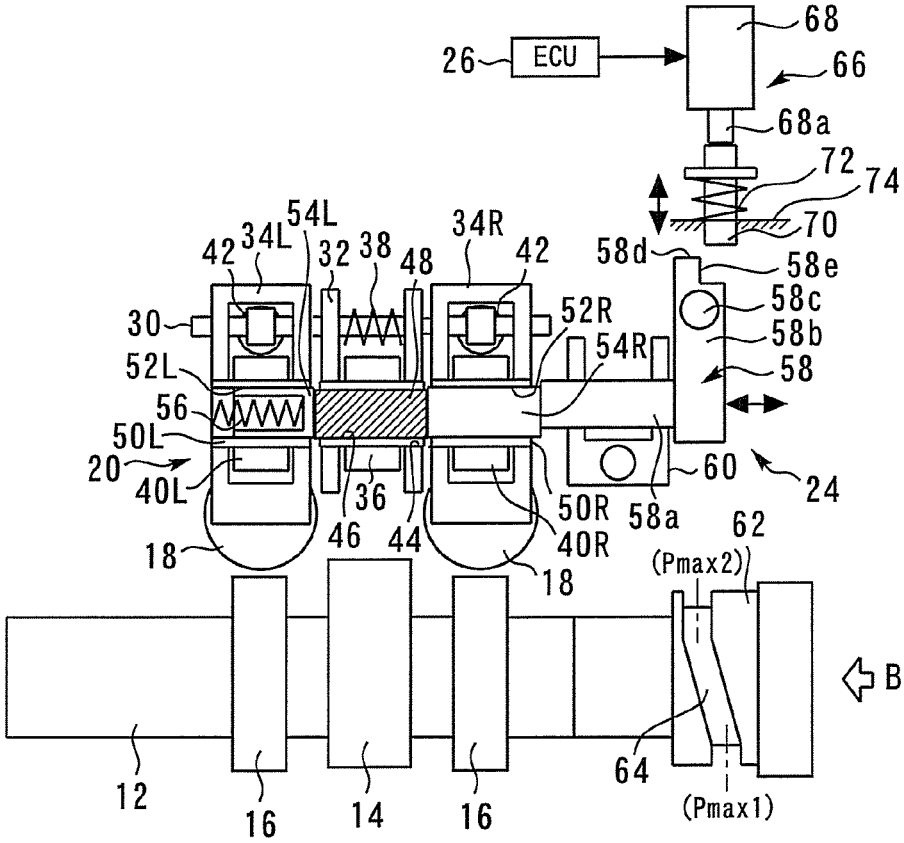
FIG. 5 is a diagram illustrating a detailed configuration of the changeover mechanism shown in FIG. 1.

FIG. 5 is a diagram illustrating a detailed configuration of the changeover mechanism 24 shown in FIG. 1. Note that, in FIG. 5, the variable mechanism 20 is represented by using a section taken at the axial centers of the rollers 36 and 40. Moreover, for the sake of simplicity of description, the mounting position of the camshaft 12 with respect to the mounting position of the variable mechanism 20 is represented in a state different from the actual mounting position excepting the axial position of the camshaft 12.

As shown in FIG. 5, a first pin hole 46 is formed within a first spindle 44 of the first roller so as to pass through in its axial direction, and the both ends of the first pin hole 46 are opened to both side surfaces of the first rocker arm 32. A first changeover pin 48 having a circular column shape is slidably inserted into the first pin hole 46. The outer diameter of the first changeover pin 48 is substantially equal to the inner diameter of the first pin hole 46, and the axial length of the first changeover pin 48 is substantially equal to the length of the first pin hole 46.

On the other hand, there is formed inside a second spindle 50L of the second roller 40 of the second rocker arm 34L side, a second pin hole 52L of which end part opposite to the first rocker arm 32 is closed and of which end part of the first rocker arm 32 side is opened. Moreover, inside a second spindle 50R of the second roller 40 of the second rocker arm 34R side, a second pin hole 52R is formed so as to pass through in its axial direction, and both ends of the second pin hole 52R are opened to the both side surfaces of the second rocker arm 34R. The inner diameters of the second pin holes 52R and 52L are equal to the inner diameter of the first pin hole 46.

A second changeover pin 54L of a circular column shape is slidably inserted into the second pin hole 52L. Moreover, inside the second pin hole 52L, there is disposed a return spring 56 which biases the second changeover pin 54L toward the first rocker arm 32 direction (hereafter, referred to as the "advancing direction of changeover pin"). The outer diameter of the second changeover pin 54L is substantially equal to the inner diameter of the second pin hole 52L. Moreover, the axial length of the second changeover pin 54L is arranged to be shorter than that of the second pin hole 52L, and an adjustment is made such that the distal end of the second changeover pin 54L slightly protrudes from the side surface of the second rocker arm 34L with the second changeover pin 54L being pressed toward inside the second pin hole 52L. Further, it is supposed that the return spring 56 is configured to, in a mounted state, constantly bias the second changeover pin 54L toward the first rocker arm 32.

A second changeover pin 54R of a circular column shape is slidably inserted into the second pin hole 52R. The outer diameter of the second changeover pin 54R is substantially equal to the inner diameter of the second pin hole 52R, and the axial length of the second changeover pin 54R is substantially equal to the length of the second pin hole 52R.

The relative positions of three pin holes 46, 52L, and 52R described so far are defined such that the axial centers of the three pin holes 46, 52L, and 52R are positioned on the same straight line L, when the first roller 36 is in abutment with the base circle part 14*a* of the main cam 14 (see FIG. 3) and the second roller 40 is in abutment with the base circle part of the auxiliary cam 16 (see FIG. 4).

Figure 6:
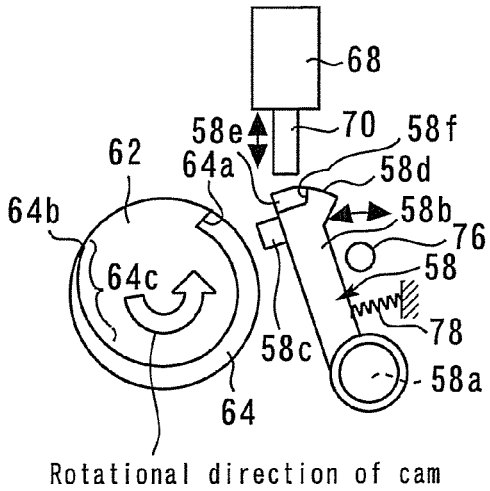
FIG. 6 is a view of the changeover mechanism seen from the axial direction of a camshaft (the direction of an arrow B in FIG. 5)

Here, newly referring to FIG. 6 as well as above-described FIG. 5, description on the changeover mechanism 24 will be continued. FIG. 6 is a view of the changeover mechanism 24 seen from the axial direction of the camshaft 12 (the direction of an arrow B in FIG. 5). Note that in the figures following FIG. 6, the relation between a rock pin 70 and a solenoid 68 is illustrated in a simplified form.

The changeover mechanism 24 includes a slide pin 58 for forcing the changeover pins 48, 54L, and 54R to be displaced toward the second rocker arm 34L side (in the retreating direction of the changeover pin) with the aid of the rotational power of the cam. The slide pin 58 includes, as shown in FIG. 5, a circular column part 58*a* having a end face which is in abutment with the end face of the second changeover pin 54R. The circular column part 58*a* is supported by a support member 60 fixed to the cam carrier so as to be advanceable/retreatable in the axial direction and rotatable in the circumferential direction.

Moreover, a bar-like arm part 58*b* is provided so as to protrude outwardly in the radial direction of the circular column part 58*a* at the end part opposite to the second changeover pin 54R in the circular column part 58*a*. That is, the arm part 58*b* is configured to be rotatable around the axial center of the circular column part 58*a*. The distal end part of the arm part 58*b* is configured, as shown in FIG. 6, to extend up to a position opposed to the peripheral surface of the camshaft 12. Moreover, a projection part 58*c* is provided at the distal end part of the arm part 58*b* so as to protrude toward the peripheral surface of the camshaft 12.

There is formed in the outer peripheral surface opposed to the projection part 58*c* in the camshaft 12, a large-diameter part 62 having a larger diameter than that of the camshaft 12. There is formed in the peripheral surface of the large-diameter part 62, a helical-shaped guide rail 64 extending in the circumferential direction. Here, the guide rail 64 is shaped as a helical groove. Note that the width of the guide rail 64 is formed to be slightly larger than the outer diameter of the projection part 58*c*.

Moreover, the changeover mechanism 24 includes an actuator 66 for inserting the projection part 58*c* into the guide rail 64. To be more specific, the actuator 66 includes a solenoid 68 which is duty controlled based on the command from the ECU 26 and a lock pin 70 which is in abutment with the drive axis 68*a* of the solenoid 68. The lock pin 70 is formed into a cylindrical shape.

One end of the spring 72, which exerts a biasing force against the thrust of the solenoid 68, is fixedly engaged to the lock pin 70 and the other end of the spring 72 is fixedly engaged to a support member 74 fixed to the cam carrier which is a stationary member. According to such configuration, when the solenoid 68 is driven based on the command from the ECU 26, the lock pin 70 can be advanced as a result of the thrust of the solenoid 68 overpowering the biasing force of the spring 72 and, on the other hand, when the driving of the solenoid 68 is stopped, the lock pin 70 and the driving shaft 68*a* can be quickly retreated to a predetermined position by the biasing force of the spring 72. Moreover, the lock pin 70 is restricted from moving in its radial direction by the support member 74. As a result, even when the lock pin 70 is subjected to a force from its radial direction, the lock pin 70 can be prevented from moving in the abovementioned direction.

Moreover, it is supposed that the solenoid 68 is fixed to a stationary member such as a cam carrier, at a position where the lock pin 70 can press the pressing surface (the surface opposite to the surface where the projection part 58*c* is provided) 58*d* of the distal end part of the arm part 58*b* of the slide pin 58 against the guide rail 64. In other words, the pressing surface 58*d* is provided in a shape and at a position where the projection part 58*c* can be pressed toward the guide rail 64 by the lock pin 70.

The arm part 58*b* of the slide pin 58 is arranged to be rotatable around the axial center of the circular column part 58*a* within a range restricted by the large-diameter part 62 of the camshaft 12 side and a stopper 76. Then, the positional relationship of each component is arranged such that when the arm part 58*b* is within the abovementioned range, and when the axial position of the slide pin 58 is at a displacement end Pmax1 described later, the lock pin 70 driven by the solenoid 68 can come into abutment with the pressing surface 58*d* of the arm part 58*b* securely. Moreover, attached to the arm part 58*b* is a spring 78 which biases the arm part 58*b* toward the stopper 76. Note that such spring 78 may not necessarily be provided such as when it is not assumed that the arm part 58*b* may fit into the helical groove 64 by the self-weight of the slide pin 58 while the solenoid 68 is not driven.

The helical direction in the guide rail 64 of the camshaft 12 is arranged such that when the camshaft 12 is rotated in a predetermined rotational direction shown in FIG. 6 with the projection part 58*c* being inserted thereinto, the slide pin 58 causes the changeover pins 48, 54L, and 54R to be displaced in the direction approaching the rocker arms 32 and 34 while pushing aside them in the retreating direction against the biasing force of the return spring 56.

Here, the position of the slide pin 58, in a state where the second changeover pin 54L is inserted into both the second pin hole 52L and the first pin hole 46 by the biasing force of the return spring 56, and where the first changeover pin 48 is inserted into both the first pin hole 46 and the second pin hole 52R, is referred to as a "displacement end Pmax1". When the slide pin 58 is positioned at this displacement end Pmax1, the first rocker arm 32 and the second rocker arms 34R and 34L all become connected with each other. Moreover, the position of the slide pin 58 in a state where as a result of the changeover pin 48 and the like being subjected to a force from the slide pin 58, the second changeover pin 54L, the first changeover pin 48, and the second changeover pin 54R are respectively inserted only into the second pin hole 52L, the first pin hole 46, and the second pin hole 52R, is referred to as a "displacement end Pmax2". That is, when the slide pin 58 is positioned at this displacement end Pmax2, the first rocker arm 32, and the second rocker arms 34R and 34L are all disconnected from each other.

In the present embodiment, the position of the proximal end 64*a* of the guide rail 64 in the axial direction of the camshaft 12 is arranged so as to coincide with the position of the projection part 58*c* when the slide pin 58 is positioned at the above-described displacement end Pmax1. Further, the position of the terminal end 64*b* of the guide rail 64 in the axial direction of the camshaft 12 is arranged so as to coincide with the position of the projection part 58*c* when the slide pin 58 is positioned at the above-described displacement end Pmax2. That is, in the present embodiment, the configuration is made such that the slide pin 58 is displacable between the displacement end Pmax1 and the displacement end Pmax2 within the range in which the projection part 58*c* is guided by the guide rail 64.

Further, as shown in FIG. 6, the guide rail 64 of the present embodiment is provided with a shallow bottom part 64*c*, in which the depth of the guide rail 64 gradually decreases as the camshaft 12 rotates, as a predetermined section of the terminal end 64*b* side after the slide pin 58 reaches the displacement end Pmax2. Note that the depth of the portion other than the shallow bottom part 64*c* in the guide rail 64 is constant.

Moreover, the arm part 58*b* in the present embodiment is provided with a notch part 58*e* which is formed into a concave shape by notching a part of a pressing surface 58*d*. The pressing surface 58*d* is provided so as to be kept in abutment with the lock pin 70 while the slide pin 58 is displaced from the displacement end Pmax1 to the displacement end Pmax2. Further, the notch part 58*e* is provided in a portion where it can be engaged with the lock pin 70 when the projection part 58*c* is taken out on the surface of the large-diameter part 62 by the action of the above-described shallow bottom part 64*c*, in a state where the slide pin 58 is positioned at the above-described displacement end Pmax2.

Moreover, the notch part 58*e* is formed so as to be engaged with the lock pin 70 in a mode in which the rotation of the arm part 58*b* in the direction in which the projection part 58*c* is inserted into the guide rail 64 can be restricted, and the movement of the slide pin 58 in the advancing direction of the changeover pin can be restricted. To be more specific, there is provided in the notch part 58*e*, a guide surface 58*f* which guides the slide pin 58 to move away from the large-diameter part 62 as the lock pin 70 moves into the notch part 58*e*.

[Operation of the Variable Valve Operating Apparatus of the Present Embodiment]

Next, the operation of the variable valve operating apparatus 10 will be described with reference to FIGS. 7 to 10.

(At the Time of Valve Operable State)

Figure 7:
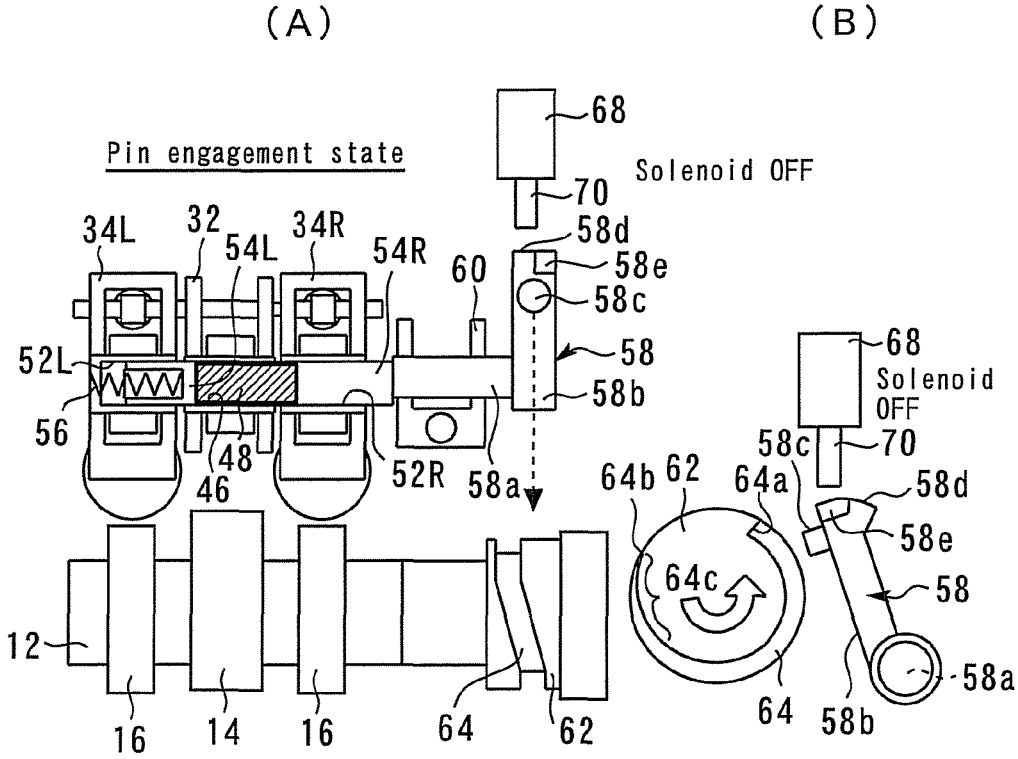
FIG. 7 is a diagram showing a control state during a valve operable state (normal lift operation)

FIG. 7 is a diagram showing a control state during a valve operable state (normal lift operation).

In this case, as shown in FIG. 7(B), the driving of the solenoid 68 is turned OFF and thus the slide pin 58 is positioned at the displacement end Pmax1 being separated from the camshaft 12 and subjected to the biasing force of the return spring 56. In this state, as shown in FIG. 7(A), the first rocker arm 32 and the two second rocker arms 34 are connected via the changeover pins 48 and 54L. As result of that, the acting force of the main cam 14 is transferred from the first rocker arm 32 to both the valves 18 via the left and right second rocker arms 34R and 34L. Thus, the normal lift operation of the valve 18 is performed according to the profile of the main cam 14.

(At the Start of Valve Stop Operation (The Start of Slide Operation))

Figure 8:
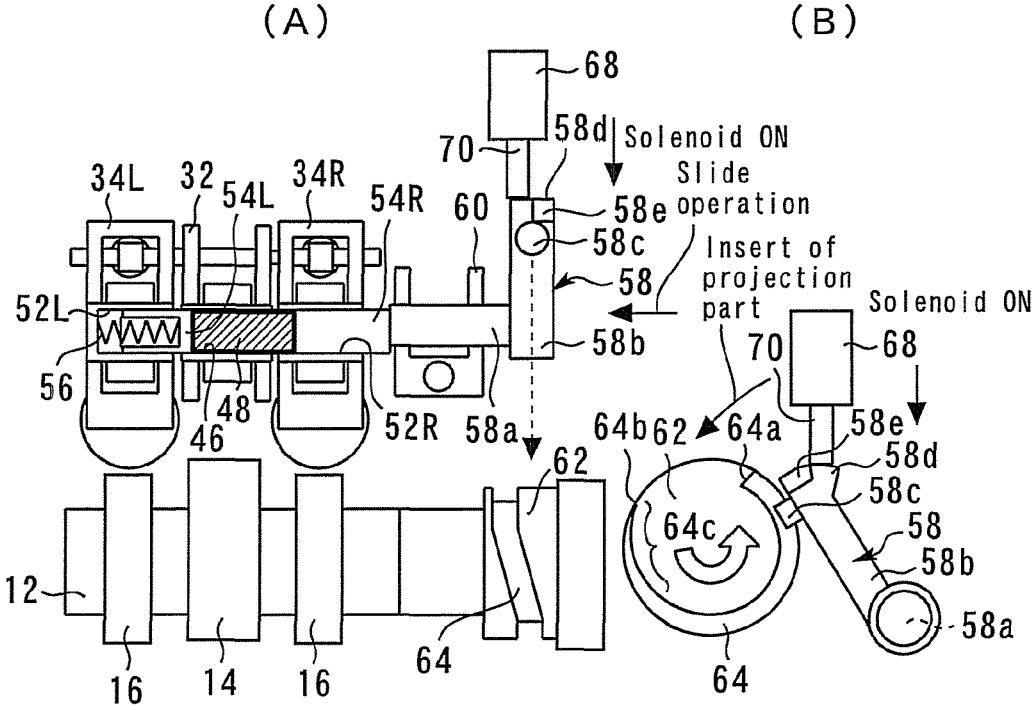
FIG. 8 is a diagram showing a control state at the start of a valve stop operation.

FIG. 8 is a diagram showing a control state at the start of a valve stop operation.

The valve stop operation is performed when, for example, an execution request of a predetermined valve stop operation such as a fuel cut request of the internal combustion engine 1 is detected by the ECU 26. Since such valve stop operation is an operation to displace the changeover pins 48, 54L, and 54R in their retreating direction by means of the slide pin 58 with the aid of the rotational force of the camshaft 12, such operation needs to be performed while the axial centers of these changeover pins 48, 54L, and 54R are positioned on the same straight line, that is, while the first rocker arm 32 is not oscillating.

In the present embodiment, the guide rail 64 is arranged such that the displacement section of the slide pin 58 in the retreating direction of changeover pins is within the base circle section. As a result of this, when the ECU 26 detects an execution request for a predetermined valve stop operation, with the solenoid 68 being driven in the order starting from a cylinder at which the base circle section first arrives, as shown in FIG. 8(B), the projection part 58*c* is inserted into the guide rail 64, thereby successively starting the valve stop operation of each cylinder. Then, as the projection part 58*c* which has been inserted into the guide rail 64 being guided by the guide rail 64, a slide operation of the slide pin 58 is started toward the displacement end Pmax2 side, as shown in FIG. 8(A), with the aid of the rotational force of the camshaft 12.

(At the Completion of Slide Operation)

Figure 9:
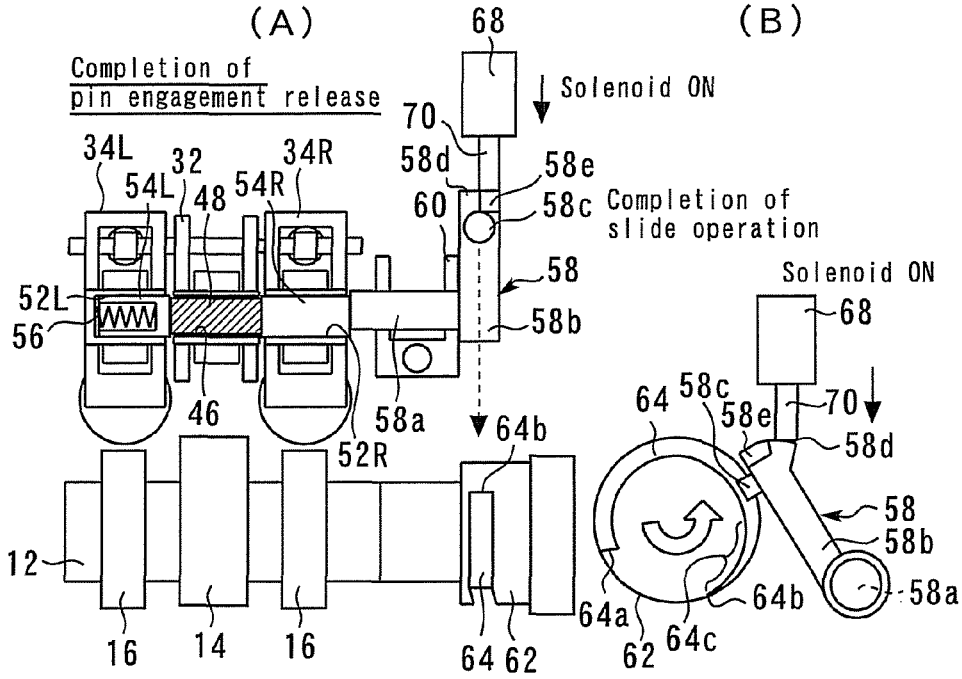
FIG. 9 is a diagram showing a control state at the completion of a slide operation.

FIG. 9 is a diagram showing a control state at the completion of the slide operation.

During the execution of the slide operation, the slide pin 58 moves toward the displacement end Pmax2, in a state in which the biasing force of the return spring 56 is received by the projection part 58*c* being in abutment with the side surface of the guide rail 64. FIG. 9(A) shows a timing at which the slide pin 58 has reached the displacement end Pmax2 and the slide operation at the time of a valve stop request is completed, that is, a timing at which the connection between the first rocker arm 32 and the second rocker arms 34R and 34L is released as a result of the first changeover pin 48 and the second changeover pin 54L becoming accommodated into the first pin hole 46 and the second pin hole 52L, respectively. Moreover, at this timing, as shown in FIG. 9(B), the position of the projection part 58*c* within the guide rail 64 has not yet reached the shallow bottom part 64*c*.

When the slide operation is completed as shown above, and the first rocker arm 32 and the second rocker arms 34R and 34L become disconnected, the first rocker arm 32, which is biased by the coil spring 38 toward the main cam 14 as the main cam 14 rotates, comes to oscillate by itself. As a result of this, the acting force of the main cam 14 is not transferred to the two second rocker arms 34. Further, since the auxiliary cam 16, against which the second rocker arm 34 abuts, is a zero lift cam, the force for driving the valve 18 is no more provided to the second rocker arms 34, to which the acting force of the main cam 14 has come not to be transferred. As a result of that, since, regardless of the rotation of the main cam 14, the second rocker arm 34 comes into a stationary state, the lift operation of the valve 18 becomes stopped at the valve closing position.

(At the Time of Holding Operation of Displacement Member)

Figure 10:
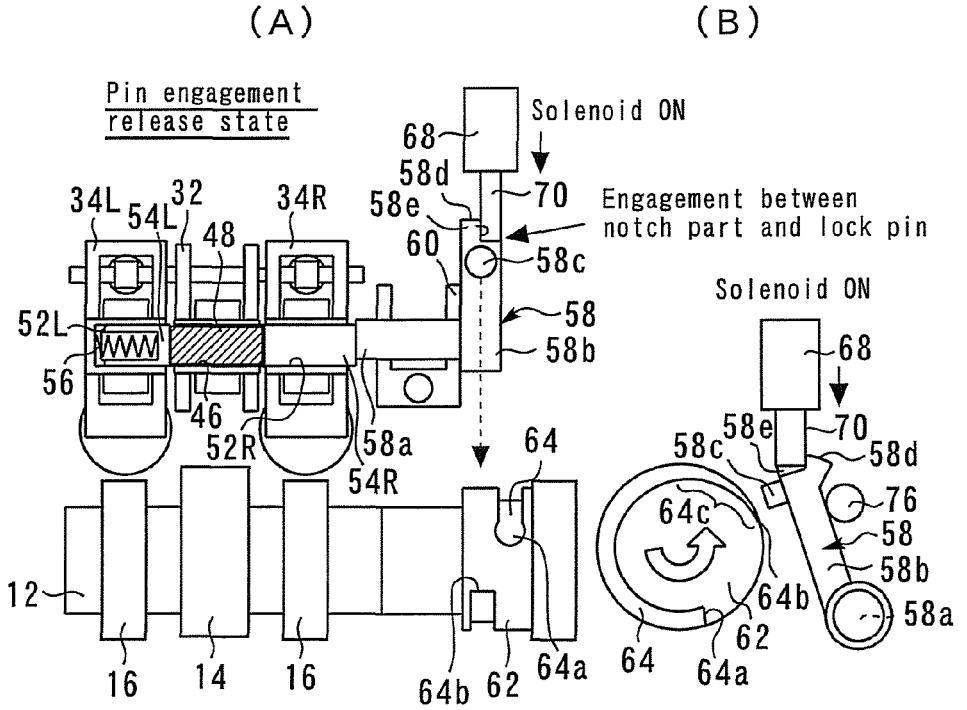
FIG. 10 is a diagram showing a control state at the time of holding operation to hold a slide pin with a lock pin.

FIG. 10 is a diagram showing a control state at the time of holding operation to hold the slide pin 58 with the lock pin 70.

When the camshaft 12 further rotates after the slide operation shown in above-described FIG. 10 is completed, the projection part 58*c* comes close to the shallow bottom part 64*c* in which the depth of the groove gradually decreases. As a result of that, the action of the shallow bottom part 64*c* causes the slide pin 58 to rotate in the direction separated from the camshaft 12. Then, as the depth of the groove decrease due to the shallow bottom part 64*c*, the lock pin 70 is displaced a little in its retreating direction. Thereafter, when the slide pin 58 further rotates until the lock pin 70 which is constantly driven by the solenoid 68, coincides with the notch part 58*e*, the portion of the slide pin 58 side, which is to be abutment with the lock pin 70, is switched from the pressing surface 58*d* to the notch part 58*e*.

As a result of that, the lock pin 70 comes to be engaged with the notch part 58*e*. As a result of this, as shown in FIG. 10(B), the slide pin 58 comes to be held with the projection part 58*c* being separated from the camshaft 12, and with the biasing force of the return spring 56 being received by the lock pin 70. For this reason, in this holding operation, as shown in FIG. 10(A), the state in which the first rocker arm 32 and the second rocker arm 34 are disconnected, that is, the valve stop state is maintained.

(At the Time of Valve Return Operation)

A valve return operation for returning the operation from the valve stop state to the valve operable state, for example, when an execution request of a predetermined valve return operation such as a request for returning from a fuel cut is detected by the ECU 26. Such valve return operation is started by the ECU 26 turning OFF the energization to the solenoid 68 at a predetermined timing (timing that is earlier than the start timing of the base circle section, in which the changeover pin 48 and the like are movable, by a predetermined time period needed for the operation of the solenoid 68), in a control state shown in FIG. 10. When the energization to the solenoid 68 is turned OFF, the engagement between the notch part 58*e* of the slide pin 58 and the lock pin 70 is released. As a result of that, the force to hold the first changeover pin 48 and the second changeover pins 54L respectively in the first pin hole 46 and the second pin hole 52L against the biasing force of the return spring 56 disappears.

Because of this, when the base circle section in which the positions of changeover pins 48, 54L, and 54R coincide arrives, the changeover pins 48 and 54L moves in the advancing direction by the biasing force of the return spring 56, thereby returning into a state in which the first rocker arm 32 and the two second rocker arms 34 are connected via the changeover pins 48 and 54L, that is, a state in which a lift operation of the valve 18 is enabled by the acting force of the main cam 14. Moreover, as the changeover pins 48 and 54L moves in the advancing direction by the biasing force of the return spring 56, the slide pin 58 is returned from the displacement end Pmax2 to the displacement end Pmax1 via the second changeover pin 54R.

Summary

According to the variable valve operating apparatus 10 of the present embodiment thus configured, it becomes possible to switch the operational states of the valve 18 between the valve operable state and the valve stop state by moving the axial position of the slide pin 58 between the displacement end Pmax1 and the displacement end Pmax2, with the aid of the ON and OFF of the energization of the solenoid 68, the rotational force of the camshaft 12, and the biasing force of the return spring 56.

To be more specific, when the valve stop request is made, by turning ON the energization of the solenoid 68 thereby inserting the projection part 58*c* into the guide rail 64, it is made possible to move the changeover pin 48 and the like in the retreating direction of changeover pin with the slide pin 58 which utilizes the rotational force of the camshaft 12. As a result of that, it becomes possible to quickly switch the first rocker arm 32 and the two second rocker arms 34 from the connected state to the disconnected state within one base circle section. This makes it possible to obtain the valve stop state. Moreover, when a valve return request is made, by turning OFF the energization of the solenoid 68 thereby releasing the engagement between the slide pin 58 and the lock pin 70, it is made possible to move the changeover pin 48 and the like and the slide pin 58 in the advancing direction of changeover pin, with the aid of the biasing force of the return spring 56. As a result of that, it becomes possible to quickly switch the first rocker arm 32 and the two second rocker arms 34 from the disconnected state to the connected state within one base circle section, and also to return the slide pin 58 to an original position (Pmax1) at which the valve stop operation can be started. This makes it possible to resume the operational state of the valve 18 to the valve operable state.

Moreover, according to the above-described variable valve operating apparatus 10, by engaging the lock pin 70 with the notch part 58*e* after the slide pin 58 reaches the displacement end Pmax2 at which the slide operation of the slide pin 58 is completed, it becomes possible to transfer the function of holding the slide pin 58 such that it is not displaced from the displacement end Pmax2 to the displacement end Pmax1 side due to the biasing force of the return spring 56, from the side surface of the guide rail 64 which is engaged with the projection part 58*c* to the lock pin 70 which is engaged with the notch part 58*e*. The arrangement is, as already described, such that in a state in which the slide pin 58 is held by the engagement between the lock pin 70 and the notch part 58*e*, the projection part 58*c* is kept separated from the camshaft 12. In this arrangement, as a result of the holding of the slide pin 58 being changed to the lock pin 70 which is stationary with respect to the axial direction after the completion of the valve stop operation, it becomes possible to avoid the occurrence of friction and attrition in association with the sliding with the rotating camshaft 12. To be more specific, the elimination of friction allows an improvement of the fuel economy of the internal combustion engine 1. Further, the elimination of the attrition of the slide pin 58 allows the control positions of the changeover pin 48 and the like to be stabilized, thereby making it possible to ensure favorable switchability of the operational states of the valve 18. In further addition, according to the configuration of the variable valve operating apparatus 10 of the present embodiment, the above-described holding function is realized between the lock pin 70 which operates integrally with the solenoid 68 which is provided for the purpose of inserting the projection part 58*c*, and the notch part 58*e* which is provided in the slide pin 58 which is provided for the purpose of moving the changeover pin 48 and the like. Therefore, it is possible to obtain the variable valve operating apparatus 10 which can favorably switch between the operational states of the valve 18 by using a simplified configuration, without leading to an increase in the number of components.

[Detailed Configuration of Restriction Means of the First Embodiment]

Figure 11:
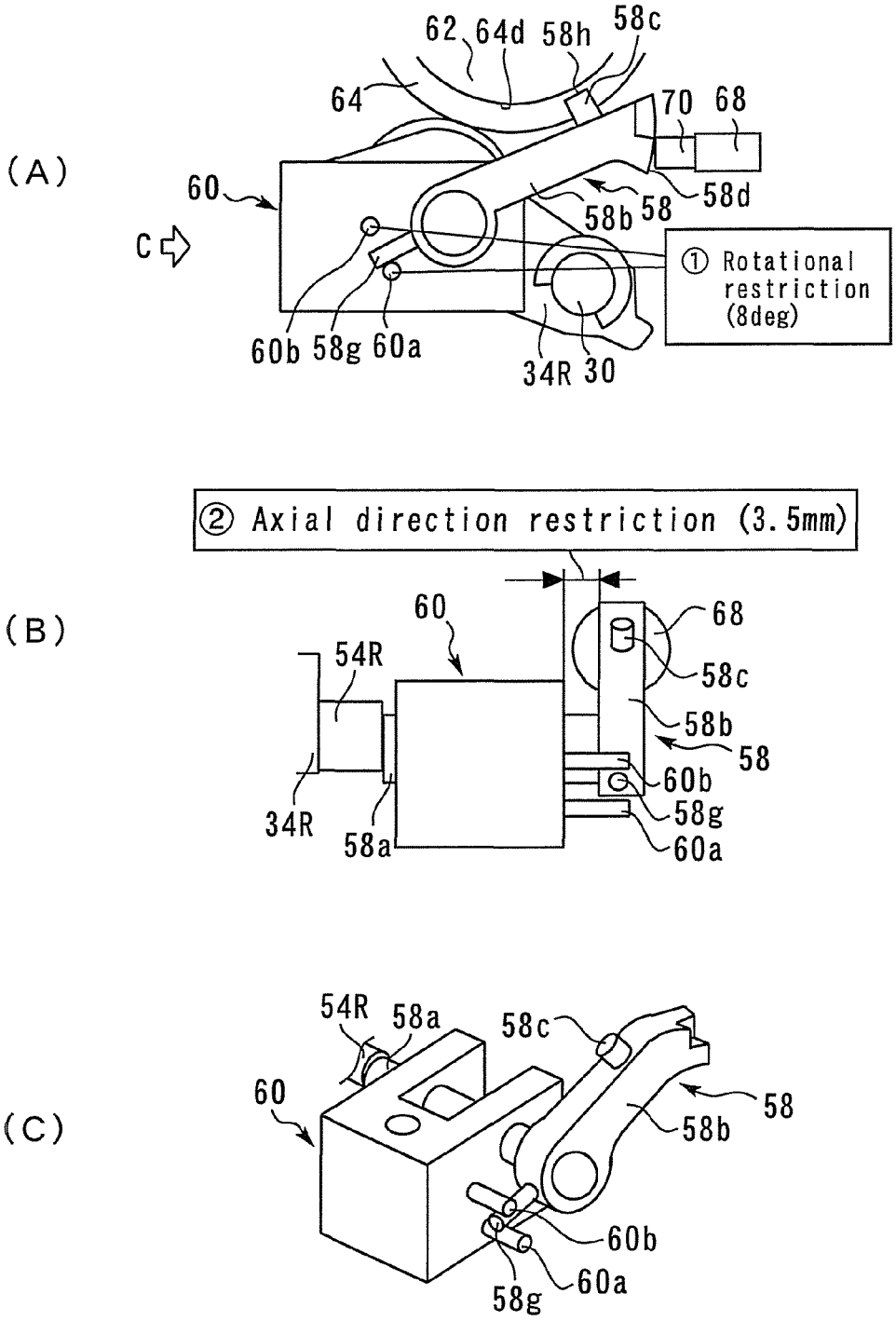
FIG. 11 is a diagram illustrating characteristic features that are applied to the changeover mechanism 24 shown in FIG. 1.

FIG. 11 is a diagram illustrating characteristic features that are applied to the changeover mechanism 24 shown in FIG. 1. To be more specific, FIG. 11(A) is a view of the changeover mechanism 24 seen from the direction of the arrow mark B in FIG. 5; FIG. 11(B) is a view of the changeover mechanism 24 seen from the direction of the arrow mark C in FIG. 11(A); and FIG. 11(C) is a perspective view of the changeover mechanism 24 for reference purposes.

The changeover mechanism 24 of the present embodiment is provided with means for restricting the rotation of the slide pin 58. To be specific, as shown in FIG. 11(A), in order to implement such restriction means, the changeover mechanism 24 is provided with a stopper pin 58*g* which is fixed at the root of the arm part 58*b*, as well as a stopper pin 60*a* in the support member 60 at a position where it can abut the stopper pin 58*g*. Note that the other stopper pin 60*b* attached to the support member 60 is for the purpose of specifying the positional relationship between the lock pin 70 and the slide pin 58 when the energization to the solenoid 68 is turned OFF. Moreover, herein an example is shown in which the rotation angle of the slide pin 58 is set to be 8 degrees by these stopper pins 60*a* and 60*b*.

As already described, the slide pin 58 is pressed by the lock pin 70 at the time of energization to the solenoid 68, thereby being rotated about the axial center of the circular column part 58*a*. This causes the projection part 58*c* to be inserted into the guide rail 64. The stopper pin 60*a* is attached at a position where it can abut the stopper pin 58*g* as shown in FIG. 11(A) in a state in which the projection part 58*c* is inserted into the guide rail 64, and there is a predetermined clearance between the top surface 58*h* of the projection part 58*c* and the bottom surface 64*d* of the guide rail 64.

According to the above-described configuration, since the rotational amount of the slide pin 58 is restricted when the projection part 58*c* is inserted into the guide rail 64, it is possible to prevent the contact between the top surface 58*h* of the projection part 58*c* and the bottom surface 64*d* of the guide rail 64.

Further, the changeover mechanism 24 of the present embodiment is provided with means for restricting the axial movement of the slide pin 58. To be specific, as shown in FIG. 11(B), such restriction means is implemented by managing the dimensions of the arm part 58*b* and the support member 60. The state shown in FIG. 11(B) indicates that the slide pin 58 is at the position (displacement end Pmax1) for realizing the valve operable state. In this case, the shapes of the slide pin 58 and the support member 60 are determined such that the dimension between the arm part 58*b* and the support member 60 is equal to the reciprocating range (that is, the distance between the displacement end Pmax1 and the displacement end Pmax2, which is herein set to be 3.5 mm) of the movement of the slide pin 58.

According to the above-described arrangements, when the slide pin 58 has moved from the displacement end Pmax1 to the displacement end Pmax2 by being guided by the guide rail 64, the arm part 58*b* comes into abutment with the support member 60, thereby making it possible to restrict the slide pin 58 from moving in the axial direction of the circular column part 58*a* beyond the displacement end Pmax2.

[Advantages of the Restriction Means of the First Embodiment]

The advantages to be obtained as a result of the provision of the above-described restriction means (rotational restriction and axial direction restriction) will be described comparing with a configuration which is not provided with the restriction means, with reference to FIGS. 12 to 17.

First, a configuration which is not provided with the above-described restriction means will be described with reference to FIGS. 12 to 14.

Figure 12:
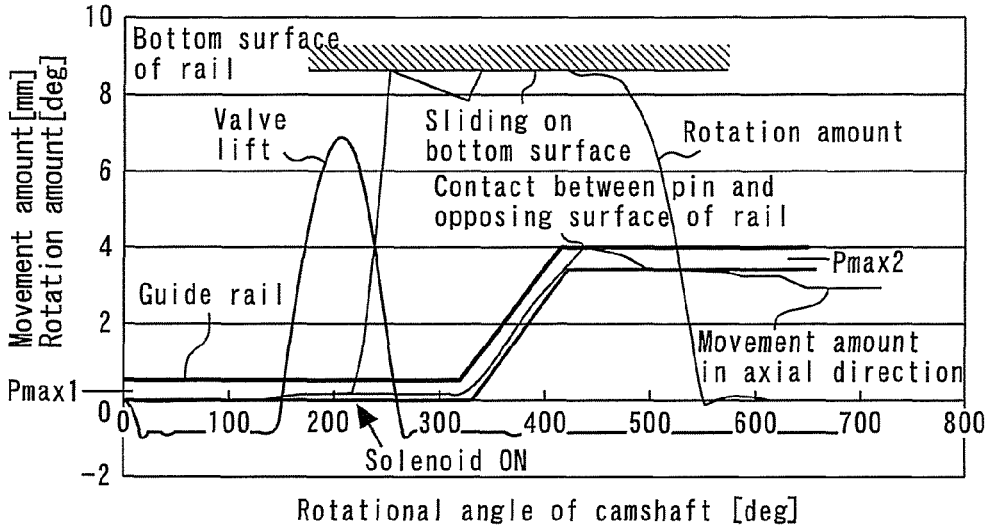
FIG. 12 is a diagram for explaining an operation of the slide pin with respect to the rotation of a camshaft, in a case in which restriction means is not provided.

FIG. 12 is a diagram for explaining an operation of the slide pin 58 with respect to the rotation of the camshaft 12, in a case in which the above-described restriction means is not provided. Moreover, FIG. 13 is a diagram for explaining an operation of the slide pin 58 that is moving in the axial direction in a case in which the above-described restriction means is not provided. Note that FIG. 13 is a development view of the guide rail 64.

In a case where the above-described restriction means for performing rotational restriction is not provided, as shown in FIG. 12, when the slide pin 58 is rotated as the solenoid 68 is energized, the top surface 58*h* of the projection part 58*c* will have contacted the bottom surface 64*d* of the guide rail 64, resulting in sliding therebetween.

Further, as already described, the slide pin 58 is subjected to a biasing force of the return spring 56 via the changeover pin 48 and the like. Because of this, when the slide pin 58 moves from the displacement end Pmax1 to the displacement end Pmax2 by being guided by the guide rail 64, as shown in FIG. 13, the projection part 58*c* of the slide pin 58 moves within the guide rail 64 against the biasing force of the return spring 56 under the condition of being pressed against one side surface 64*e* of the guide rail 64. Herein, this side surface 64*e* is specifically referred to as a "load bearing surface 64*e*" and the other side surface of the guide rail 64, which opposes to the side surface 64*e*, is referred to as an "opposing surface 64*f*".

Figure 13:
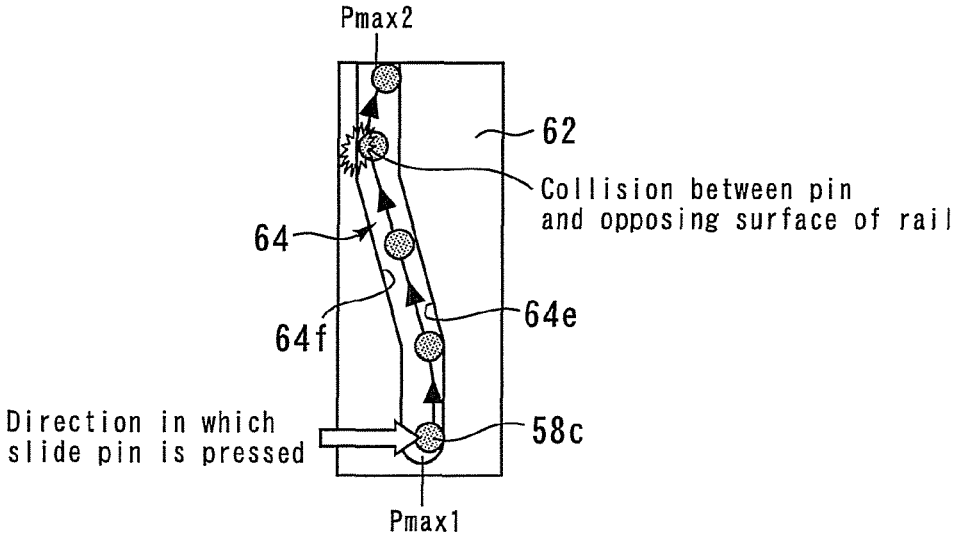
FIG. 13 is a diagram for explaining an operation of the slide pin that is moving in the axial direction in a case in which the restriction means is not provided.

If the above-described restriction means for performing the restriction of the movement in axial direction, as shown in FIGS. 12 and 13, when an oblique section in which the slide pin 58 moves from the displacement end Pmax1 to the displacement end Pmax2 along the guide rail 64 has ended, the projection part 58*c* collides with the opposing surface 64*f*.

Figure 14:
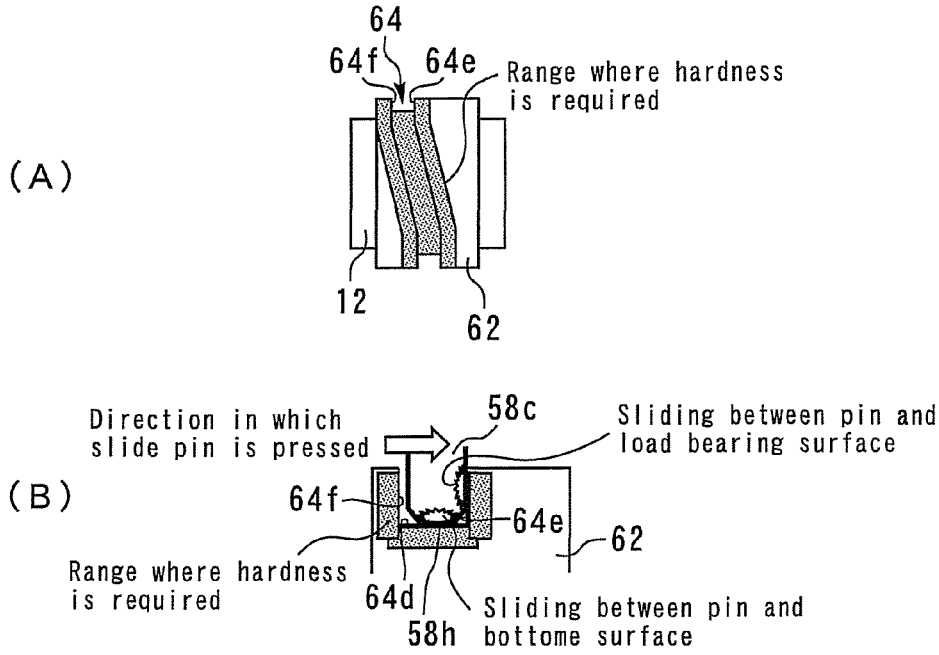
FIG. 14 is a diagram for explaining a range where hardness is required (heat treatment range) of a guide rail in the case in which the restriction means is not provided.

FIG. 14 is a diagram for explaining a range where hardness is required (heat treatment range) of the guide rail 64 in the case in which the above-described restriction means is not provided. Note that FIG. 14(B) is a sectional view of the guide rail 64.

As described above, if the above-described restriction means for performing the rotational restriction is not provided, sliding occurs not only between the projection part 58*c* and the load bearing surface 64*e*, but also between the top surface 58*h* of the projection part 58*c* and the bottom surface 64*d* of the guide rail 64. Further, the opposing surface 64*f* is also subjected to the above-described collision with the projection part 58*c* in the straight section of the guide rail 64. For this reason, as shown in FIG. 14, not only the load bearing surface 64*e* but also the bottom surface 64*d* and the opposing surface 64*f* of the guide rail 64 need to be subjected to surface treatment for sufficiently ensuring the hardness of sliding portions. Note that as such surface treatment, using a heat treatment by a laser quenching is effective in the aspect of cost and easiness of production.

As so far described, if the above-described restriction means is not provided, since the operation of the slide pin 58 is restricted by the guide rail 64, it becomes necessary to apply heat treatment to the entire region of the guide rail 64. If the range where hardening by such heat treatment is required broadens, it becomes necessary to broaden heat input range and increase the input amount during heat treatment. However, if the heat input range broadens or the heat input amount increases during heat treatment, the distortion which occurs in the camshaft 12 increases. As a result of that, due to deformation of the camshaft 12 such as a bending, friction loss of the internal combustion engine 1 increases, thereby degrading fuel economy.

Next, the configuration of the present embodiment which is provided with the above-described restriction means will be described with reference to FIGS. 15 and 16.

Figure 15:
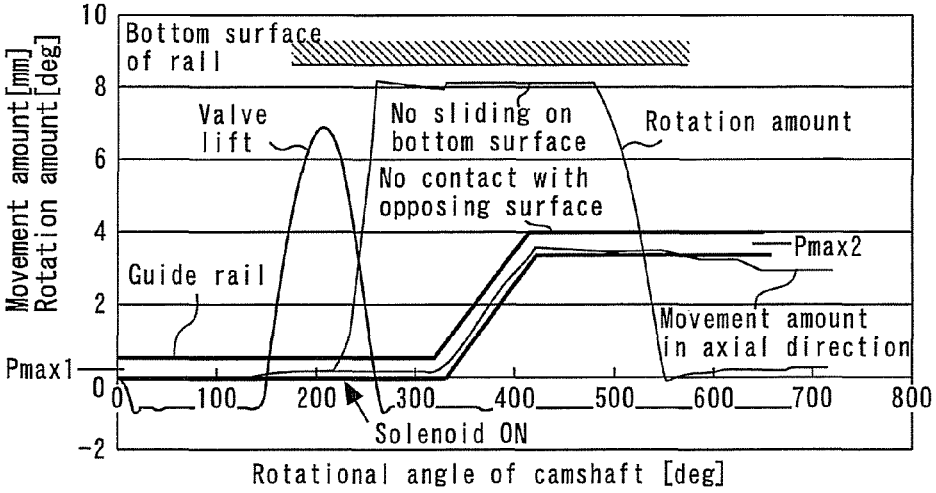
FIG. 15 is a diagram for explaining an operation of the slide pin in response to the rotation of the camshaft, in a case in which the restriction means is provided.

FIG. 15 is a diagram for explaining an operation of the slide pin 58 in response to the rotation of the camshaft 12, in a case in which the above-described restriction means is provided.

Since the changeover mechanism 24 of the present embodiment is provided with the above-described restriction means for performing rotational restriction, as shown in FIG. 15, the top surface 58*h* of the projection part 58*c* and the bottom surface 64*d* of the guide rail 64 do not come into contact with each other when the slide pin 58 rotates as the solenoid 68 is energized.

Further, the restriction means is arranged such that the rotation of the slide pin 58 is restricted by the use of the stopper pin 58*g* provided in the arm part 58*b* of the slide pin 58 and the stopper pin 60*a* provided in the support member 60. In contrast to such method, a configuration may be adopted in which for example, the height of the projection part 58*c* is made smaller than the depth of the guide rail 64 so that a contact between the top surface 58*h* of the projection part 58*c* and the bottom surface 64*d* of the guide rail 64 is avoided. However, in the case of such a configuration, it cannot be avoided that sliding occurs between the arm part 58*b* in the periphery of the projection part 58*c* and the large-diameter part 62 of the camshaft 12. Moreover, if such sliding occurs, it becomes necessary to increase heat-treated portions in the camshaft 12 side. In contrast, according the rotation restriction method of the present embodiment, it is possible to restrict the rotation of the slide pin 58 at a portion where there is no need of relying on the abutment with the camshaft 12 which is a rotational body. That is, it is possible to implement a rotational restriction of the slide pin 58 without being attended with sliding between the slide pin 58 and the camshaft 12. Further, since the stopper pin 58*g* and the stopper pin 60*a* are sufficiently small relative to the camshaft 12, heat treatment for ensuring hardness can be easily performed compared with performing heat treatment to the camshaft 12.

Further, since the present changeover mechanism 24 is provided with the above-described restriction means for performing the restriction of axial movement, as shown in FIG. 15, the projection part 58*c* does not come into contact with the opposing surface 64*f* when the slide pin 58 has passed the oblique section of the guide rail 64.

To be more specific, in the restriction means, the movement range of the slide pin 58 is not restricted between the guide rail 64 and the projection part 58*c*, but the axial movement of the slide pin 58 is restricted between the arm part 58*b* of the slide pin 58 and the support member 60. According to such restriction method of axial movement, it is possible to restrict the axial movement of the slide pin 58 at a portion where there is no need of relying on abutment with the camshaft 12 which is a rotational body. That is, it is possible to realize a restriction of the axial movement of the slide pin 58 without being attended with sliding between the slide pin 58 and the camshaft 12.

Figure 16:
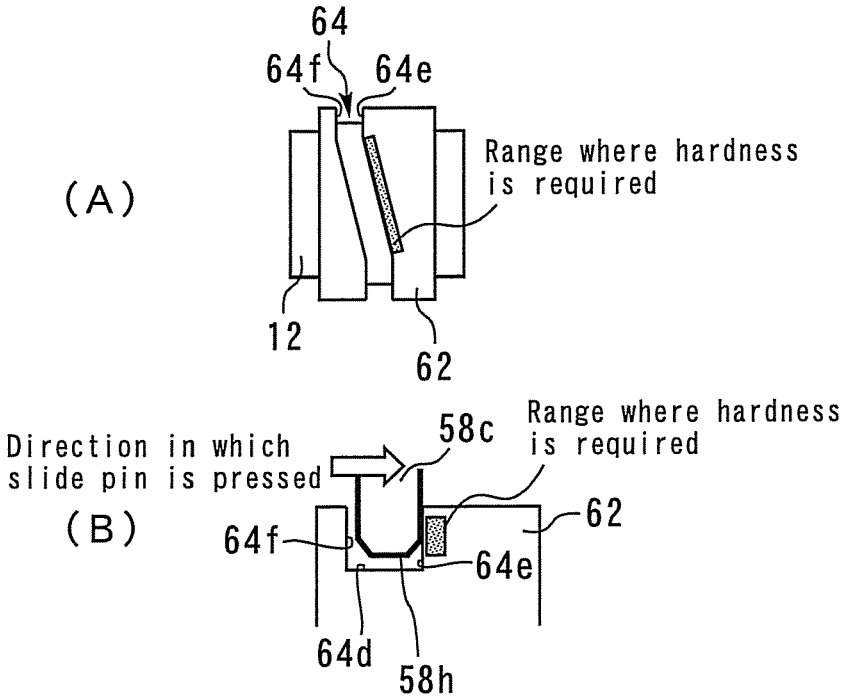
FIG. 16 is a diagram for explaining the range where hardness is required (heat treatment range) of the guide rail in the case in which the restriction means is provided.

FIG. 16 is a diagram for explaining the range where hardness is required (heat treatment range) of the guide rail 64 in the case in which the above-described restriction means is provided.

Performing the rotational restriction and the restriction of the axial movement described above makes it possible to effectively reduce the sliding portion between the projection part 58*c* and the guide rail 64 when the slide pin 58 moves in the axial direction of the camshaft 12 by being guided by the guide rail 64. Therefore, as shown in FIG. 16, the heat treatment can be done away with on the portion other than the oblique section on the load bearing surface 64*e* side in the guide rail 64. Since, as a result of this, the heat input range and the heat input amount during heat treatment can be effectively reduced, it becomes possible to favorably suppress the distortion which occurs in the camshaft 12, to a low level. Since, as a result of that, the deformation of the camshaft 12 such as a bending can be suppressed, it is possible to prevent an increase in the friction loss of the internal combustion engine 1.

Figure 17:
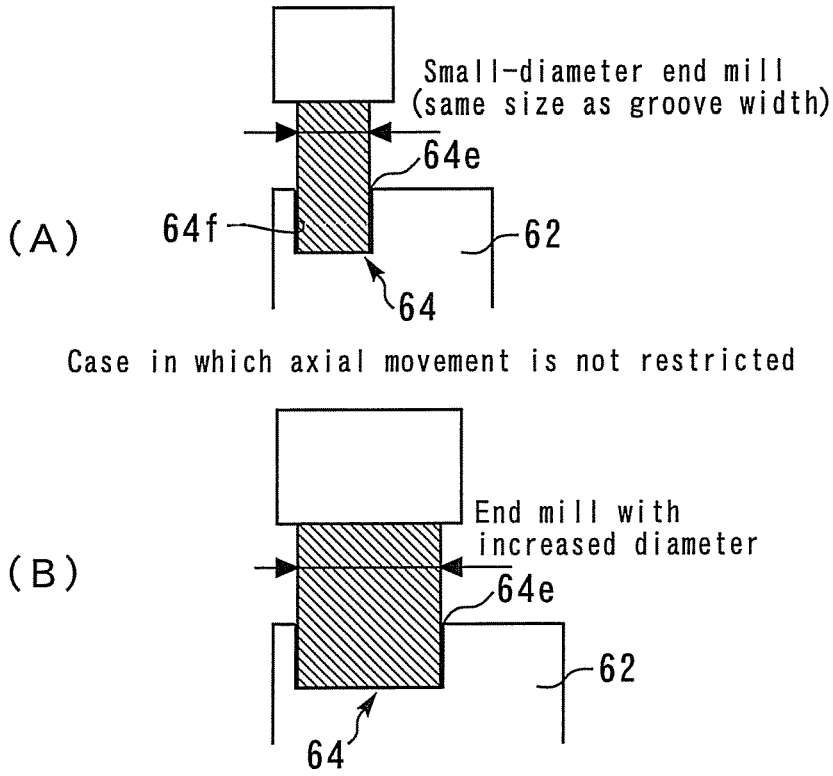
FIG. 17 is a diagram for explaining further advantages of the adaptation of the restriction means for restricting the axial movement of the slide pin.

FIG. 17 is a diagram for explaining further advantages of the adaptation of the above-described restriction means for restricting the axial movement of the slide pin 58.

If the above-described restriction means for restricting the axial movement is not provided, it is necessary to form the opposing surface 64*f* along with the load bearing surface 64*e* when creating the shape of the guide rail 64 by machining. Therefore, as shown in FIG. 17(A), it is necessary to use a small-diameter end mill (tool) having the same diameter as the groove diameter of the guide rail 64. However, if it is not possible to sufficiently ensure the diameter of the end mill, a problem arises in that the cutting tool becomes short-lived.

In contrast, if the above-described restriction means for restricting the axial movement is provided, there is no need of providing the above-described opposing surface 64*f* for the purpose of restricting the axial movement of the slide pin 58. That is, it is only necessary to create the shape of the wall part on the load bearing surface 64*e* side of the guide rail 64 according to a predetermined dimension at the time of machining. Therefore, as shown in FIG. 17(B), it is possible to use an end mill having a sufficient diameter, thereby favorably ensuring the machinability of the guide rail 64.

Meanwhile, in the first embodiment, which has been described above, it is arranged such that dimensional management of the arm part 58*b* and the support member 60 is utilized to perform the restriction of the axial movement of the slide pin 58. However, the restriction means for restricting the movement of the displacement member in the present invention is not limited to such configuration, but may be implemented by adding components for implementing the restriction, as desired. For example, a C-ring may be attached to a position on the circular column part 58*a* of the slide pin 58 and where the slide pin 58 can abut the support member 60 when the slide pin 58 is displaced to the displacement end Pmax2.

Note that in the first embodiment, which has been described above, the slide pin 58 corresponds to the "displacement member" according to the first aspect of the present invention; the guide rail 64 corresponds to the "guide part" according to the first aspect of the present invention; the actuator 66 corresponds to the "engagement control means" according to the first aspect of the present invention; and the stopper pin 58*g* and the stopper 60*a*, and the arm part 58*b* and the support member 60 which are managed to have dimensions shown in FIG. 11(B) correspond to the "restriction means" according to the first aspect of the present invention.

Further, in the first embodiment, which has been described above, the circular column part 58*a* of the slide pin 58 corresponds to the "main shaft part" according to the second or third aspect of the present invention.

Second Embodiment

Next, a second embodiment of the present invention will be described with reference to FIGS. 18 to 24.

It is supposed that the variable valve operating apparatus of the present embodiment is configured in the same manner as the variable valve operating apparatus 10 according to the first embodiment described above except the points described below.

Figure 18:
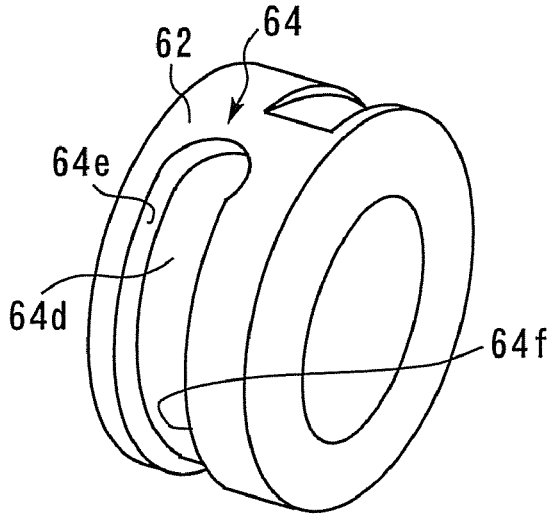
FIG. 18 is a perspective view that intends to describe the shape of a guide rail in a second embodiment of the present invention.
Figure 18:
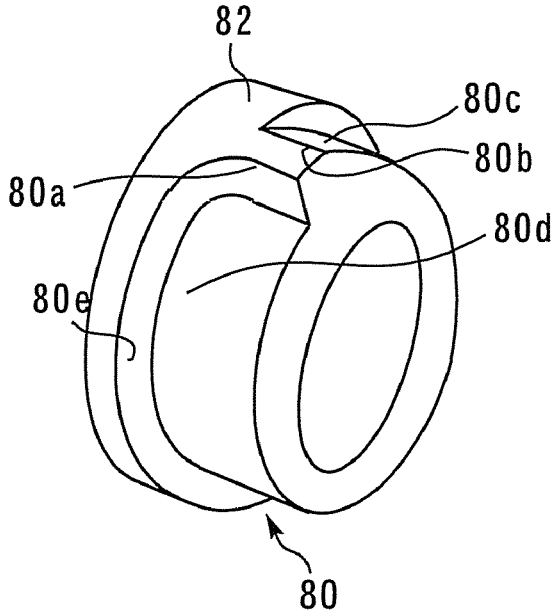

FIG. 18 is a perspective view that intends to describe the shape of a guide rail 80 in the second embodiment of the present invention. To be more specific, FIG. 18(A) shows the guide rail 64 of the above-described first embodiment which is referred to for comparison. The groove diameter of this guide rail 64 is specified in accordance with the diameter of the projection part 58*c* of the slide pin 58, and is equal to the diameter of the projection part 58*c*.

On the other hand, FIG. 18(B) shows the shape of the guide rail 80 of the present embodiment. To be more specific, in the guide rail 80, a load bearing surface 80*e* which bears the load of a slide pin 84 (see FIG. 19), which acts via a projection part 84*c* (see FIG. 19), is formed in the outer peripheral surface of a large-diameter part 82 of the camshaft 12 as a guide wall of a stepped shape. It is configured such that the projection part 84*c* is guided by this load bearing surface 80*e* thereby enabling the slide pin 58 to move from the displacement end Pmax1 to the displacement end Pmax2 as the camshaft 12 rotates.

Moreover, in the guide rail 80, as shown in FIG. 18(B), there is provided no wall part which corresponds to the opposing surface 64*f* in the guide rail 64, in a portion which opposes to the load bearing surface 80*e* via the projection part 84*c* therebetween. In further addition, this opposing portion is formed so as to be in the same plane with a bottom surface 80*d* of the guide rail 80 opposing a top surface 84*h* (see FIG. 19) of the projection part 84*c*. Note that portions shown by reference characters "80*a*", "80*b*", and "80*c*" in FIG. 18(B) are the proximal end, terminal end, and shallow bottom part of the guide rail 80, respectively.

Figure 19:
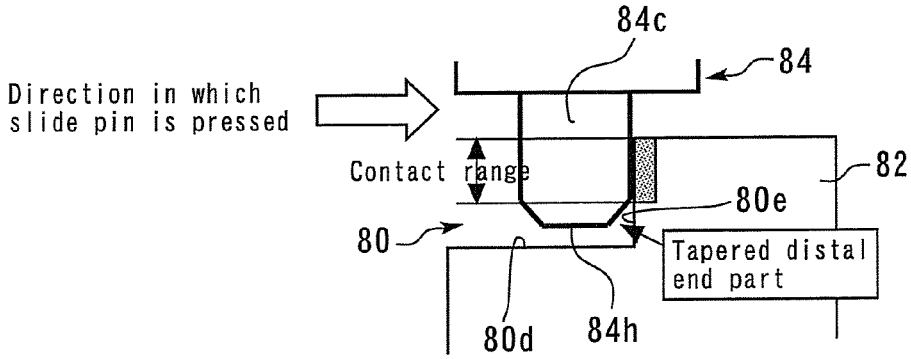
FIG. 19 is a sectional view to show a relationship between the guide rail and a projection part.

FIG. 19 is a sectional view to show the relationship between the guide rail 80 and the projection part 84*c*.

As shown in FIG. 19, the distal end part of the projection part 84*c* is formed into a tapered shape with a decreasing diameter toward the top surface 84*h* side. According to such configuration, it is possible to reduce the contact range between the projection part 84*c* and the load bearing surface 80*e*. This makes it possible to reduce the range of the guide rail 80 where hardness is to be ensured by heat treatment.

Figure 20:
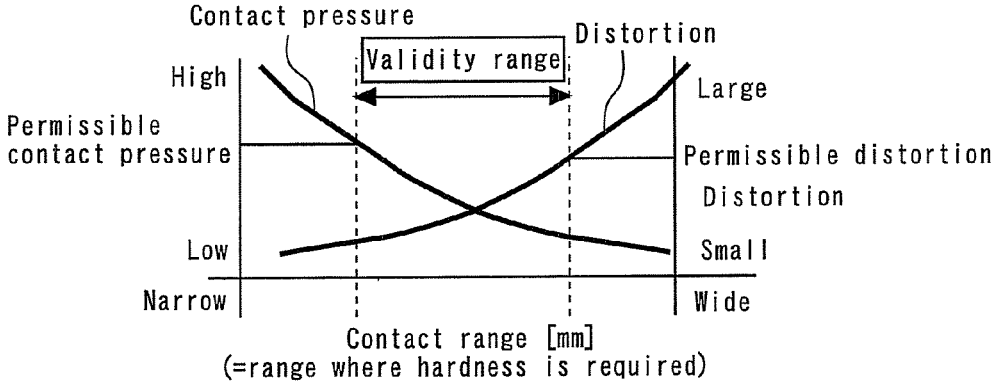
FIG. 20 is a diagram for explaining a preferable determination method of the size of a tapered part of the projection part.

FIG. 20 is a diagram for explaining a preferable determination method of the size of the tapered part of the projection part 84*c*.

As shown in FIG. 20, as the size of the tapered part is increased thereby decreasing the contact range between the projection part 84*c* and the load bearing surface 80*e*, the contact pressure of the contact part increases. On the contrary, as the contact range is broadened, although the above-described contact pressure decreases, the heat input range and the heat input amount by heat treatment increases, thereby resulting in an increase in the distortion of the camshaft 12. Therefore, as shown in FIG. 20, taking into consideration a permissible contact pressure and a permissible distortion, it is preferable to determine the dimension of the tapered part of the projection part 84*c* such that the above-described contact range which can keep both within permissible values at the same time can be obtained.

Figure 21:
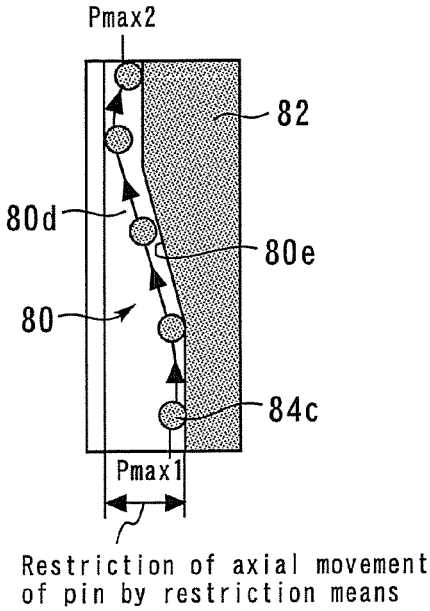
FIG. 21 is a view (a development view of the guide rail) for explaining an operation of a slide pin when making an axial movement guided by the guide rail shown in FIG. 18(B)

FIG. 21 is a view (a development view of the guide rail 80) for explaining an operation of the slide pin 84 when making an axial movement guided by the guide rail 80 shown in FIG. 18(B).

In the present embodiment as well, as in the first embodiment, the above-described restriction means for performing rotational restriction is provided in the changeover mechanism 24. This makes it possible to prevent the contact between the top surface 84*h* of the projection part 84*c* and the bottom surface 80*d* of the guide rail 80 when the slide pin 84 moves.

Further, in the present embodiment as well, the changeover mechanism 24 is provided with the above-described restriction means for performing the restriction of axial movement. This makes it possible to restrict the center of the projection part 84*c* from moving beyond the displacement end Pmax2 with the restriction means when the slide pin 84 (projection part 84*c*) moves, as shown in FIG. 21, in the axial direction by being guided by the guide rail 80. That is, since the above-described restriction means is provided, the slide pin 84 can be moved without hindrance even if a guide wall opposing the load bearing surface 80*e* is not provided on the guide rail 80 side.

Figure 22:
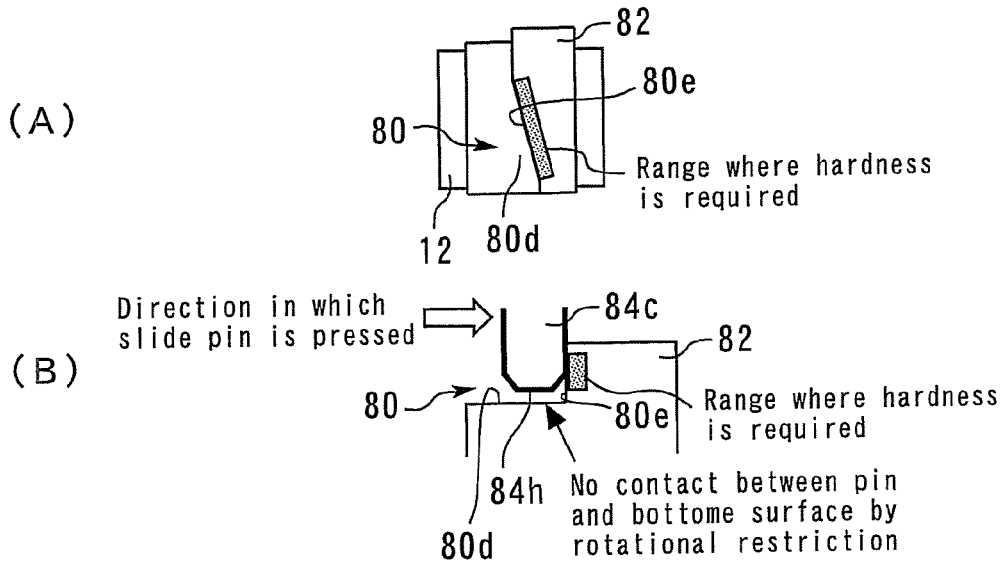
FIG. 22 is a diagram for explaining a range where hardness is required (heat treatment range) of the guide rail shown in FIG. 18(B)

FIG. 22 is a diagram for explaining a range where hardness is required (heat treatment range) of the guide rail 80 shown in FIG. 18(B).

In the present embodiment as well, performing the rotational restriction and the restriction of axial movement described above makes it possible to effectively reduce the sliding portion between the projection part 84*c* and the guide rail 80 when the slide pin 84 moves in the axial direction of the camshaft 12 by being guided by the guide rail 80. Therefore, as shown in FIG. 22, heat treatment is needed only for the oblique section of the load bearing surface 80*e* in the guide rail 80. As a result of this, in the present embodiment as well, since the heat input range and the heat input amount during heat treatment can be effectively reduced, it becomes possible to favorably restrict the distortion which occurs in the camshaft 12, to a low level.

Figure 23:
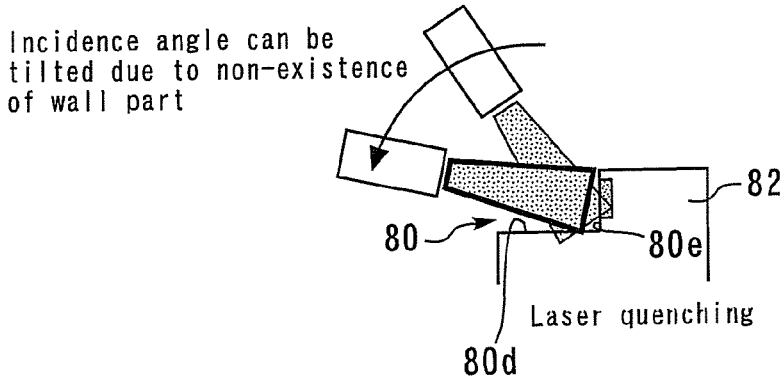
FIG. 23 is a view to illustrate the effect achieved by adopting the guide rail of a shape shown in FIG. 18(B)

FIG. 23 is a view to illustrate the effect achieved by adopting the guide rail 80 of a shape shown in FIG. 18(B).

If, contrasted with the guide rail 80 of the present embodiment, the opposing surface 64*f* opposing the load bearing surface 64*e* is provided like the guide rail 64 of the first embodiment described above, the following problem arises at the time of heat treatment by a laser quenching. That is, when performing the heat treatment by the laser quenching on the range where hardness is required shown in above-described FIG. 16, the presence of the opposing surface 64*f* becomes a hindrance. For this reason, it becomes difficult to perform the heat treatment with only the load bearing surface 64*e* as the target, resulting in an increase in the amount of heat input to the shaft center of the camshaft 12. As a result of that, the camshaft 12 is more likely to be subject to distortion.

On the other hand, the guide rail 80 of the present embodiment does not include, as already described, a wall part which corresponds to the above-described opposing surface 64*f*. For this reason, as shown in FIG. 23, it is possible to sufficiently tilt the incidence angle of a laser at the time of the laser quenching, thereby irradiating the laser at a right angle to the load bearing surface 80*e*. This makes it easy to perform the heat treatment with only the load bearing surface 80*e* as the target, thereby favorably reducing the amount of heat input to the shaft center of the camshaft 12. As a result of this, it becomes possible to perform the heat treatment while favorably restricting the distortion of the camshaft 12.

Figure 24:
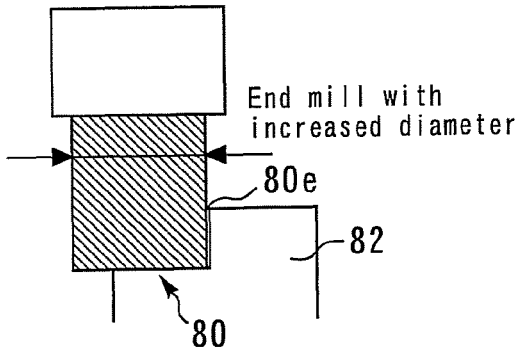
FIG. 24 is a view to illustrate a preferable processing method of the guide rail shown in FIG. 18(B).

FIG. 24 is a view to illustrate a preferable processing method of the guide rail 80 shown in FIG. 18(B).

Further, in the present embodiment as well, since as a result of the provision of the above-described restriction means for performing the restriction of axial movement, there is no need of providing a wall part corresponding to the above-described opposing surface 64*f*, it becomes possible to form the guide rail 80 by using an end mill having a necessary and sufficient diameter. In addition, in the present embodiment, since an arrangement is positively made such that the above-described wall part is not provided, using a large diameter end mill as shown in FIG. 24, it becomes possible to easily create the shape of the guide rail 80, which includes the above-described load bearing surface 80*e*, and does not include the above-described wall part, through a one-step machining process.

Note that in the first embodiment, which has been described above, the load bearing surface 80*e* corresponds to the "guide wall" in the fourth aspect of the present invention.

The invention claimed is:

1. A variable valve operating apparatus for an internal combustion engine, comprising:

a variable mechanism disposed between a cam and a valve, the variable mechanism being adapted to change valve-opening characteristics of the valve; and a changeover mechanism for switching between operational states of the variable mechanism, wherein the changeover mechanism includes:

a displacement member adapted to move within a predetermined reciprocating range thereby switching between the operational states of the variable mechanism;

a guide part provided in an outer peripheral surface of a camshaft to which the cam is fixed, the guide part being adapted to guide movement of the displacement member from one end to a remaining end of the reciprocating range;

a projection part provided in the displacement member, the projection part being engageable with the guide part;

engagement control means for switching between an engagement state and a non-engagement state of the projection part and the guide part; and restriction means for performing at least one of a restriction of contact between a top surface of the projection part and a surface of the guide part opposing the projection part, and a restriction of movement of the displacement member beyond a distance from the one end to the remaining end.

2. The variable valve operating apparatus for the internal combustion engine according to claim 1, wherein the displacement member includes a main shaft part which is in contact with the variable mechanism, wherein the changeover mechanism includes a support member which supports the main shaft part being axially movable and rotatable, wherein the displacement member includes an arm part fixed to the main shaft part to be rotatable about an axial center of the main shaft part;

wherein the projection part is fixed to the arm part, and wherein the restriction means is means for performing the restriction of the contact between the top surface of the projection part and the surface of the guide part opposing the projection part through a restriction of a rotational amount of the arm part with respect to the support member.

3. The variable valve operating apparatus for the internal combustion engine according to claim 1, wherein the displacement member includes a main shaft part which is in contact with the variable mechanism, wherein the changeover mechanism includes a support member which supports the main shaft part being axially movable and rotatable, wherein the displacement member includes an arm part fixed to the main shaft part so as to be rotatable about an axial center of the main shaft part, wherein the projection part is fixed to the arm part, and wherein when the displacement member is located in the remaining end of the reciprocating range, the restriction, by the restriction means, of the movement of the displacement member beyond the distance from the one end to the remaining end is realized by the arm part coming into abutment with the support member.

4. The variable valve operating apparatus for the internal combustion engine according to claim 1, wherein the restriction means is means which performs at least the restriction of the movement of the displacement member beyond the distance from the one end to the remaining end, and wherein the camshaft includes a guide wall of a stepped shape in the outer peripheral surface as the guide part, and does not include a wall part at a portion opposing the guide wall with the projection part interposed therebetween.

5. The variable valve operating apparatus for the internal combustion engine according to claim 1, wherein the variable mechanism includes a first rocker arm which oscillates in synchronicity with the cam and a second rocker arm which can press the exhaust valve, and wherein the changeover mechanism is a mechanism which includes a changeover pin disposed to be insertable to a pin hole formed in the first rocker arm and the second rocker arm respectively, and wherein the changeover mechanism is the mechanism which switches between a connection state in which the first rocker arm and the second rocker arm are in connection with each other via the changeover pin and a disconnection state in which the connection is released in response to the movement of the displacement member which is in contact with the changeover pin.

6. A variable valve operating apparatus for an internal combustion engine, comprising:

a variable mechanism disposed between a cam and a valve, the variable mechanism being adapted to change valve-opening characteristics of the valve; and a changeover mechanism for switching between operational states of the variable mechanism, wherein the changeover mechanism includes:

a displacement member adapted to move within a predetermined reciprocating range thereby switching between the operational states of the variable mechanism;

a guide part provided in an outer peripheral surface of a camshaft to which the cam is fixed, the guide part being adapted to guide movement of the displacement member from one end to remaining end of the reciprocating range;

a projection part provided in the displacement member, the projection part being engageable with the guide part;

an engagement control device for switching between an engagement state and a non-engagement state of the projection part and the guide part; and a restriction device for performing at least one of a restriction of contact between a top surface of the projection part and a surface of the guide part opposing the projection part, and a restriction of movement of the displacement member beyond a distance from the one end to the remaining end.

* * * * *